US008157928B2

(12) United States Patent
Tanaka et al.

(10) Patent No.: US 8,157,928 B2
(45) **Date of Patent: *Apr. 17, 2012**

(54) NON-ORIENTED ELECTRICAL STEEL SHEET AND PRODUCTION PROCESS THEREOF

(75) Inventors: Ichirou Tanaka, Osaka (JP); Hiroshi Fujimura, Osaka (JP); Hirokatsu Nitomi, Osaka (JP); Hiroyoshi Yashiki, Osaka (JP); Kouji Nishida, Osaka (JP); Hiroki Takamaru, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/917,707

(22) Filed: Nov. 2, 2010

(65) Prior Publication Data

US 2011/0042625 A1 Feb. 24, 2011

Related U.S. Application Data

(63) Continuation of application No. 11/988,296, filed as application No. PCT/JP2005/022368 on Dec. 6, 2005, now Pat. No. 7,922,834.

(30) Foreign Application Priority Data

| | | |
|---|---|---|
| Jul. 7, 2005 | (JP) | 2005-198794 |
| Jul. 19, 2005 | (JP) | 2005-208597 |
| Jul. 25, 2005 | (JP) | 2005-214625 |

(51) Int. Cl.
*C21D 8/12* (2006.01)
*C22C 38/02* (2006.01)

(52) U.S. Cl. ..... 148/307; 148/306; 148/110; 148/111; 148/112; 148/113

(58) Field of Classification Search ..... 148/110–113, 148/120–122, 306–311
See application file for complete search history.

(56) References Cited

U.S. PATENT DOCUMENTS

| | | | | |
|---|---|---|---|---|
| 4,306,922 | A | 12/1981 | Coombs et al. | |
| 2011/0056592 | A1* | 3/2011 | Arita et al. | 148/504 |

FOREIGN PATENT DOCUMENTS

| | | |
|---|---|---|
| CN | 120635 | 12/1998 |
| EP | 0 875 586 | 11/1998 |
| JP | 47-25249 | 7/1972 |
| JP | 60-238421 | 11/1985 |
| JP | 01-162748 | 6/1989 |
| JP | 02-008346 | 1/1990 |

(Continued)

*Primary Examiner* — Deborah Yee
(74) *Attorney, Agent, or Firm* — Clark & Brody

(57) ABSTRACT

A main object thereof is to provide a non-oriented electrical steel sheet being excellent in surface characteristics and having both excellent mechanical characteristics and magnetic characteristics necessary for a rotor of rotating machines such as motors and generators which rotate at a high speed, and a method for producing the same. To achieve the object, the present invention provides a non-oriented electrical steel sheet comprising in % by mass: 0.06% or less of C; 3.5% or less of Si; from 0.05% or more to 3.0% or less of Mn; 2.5% or less of Al; 0.30% or less of P; 0.04% or less of S; 0.02% or less of N; at least one element selected from the group consisting of Nb, Ti, Zr and V in the predetermined range; and a balance consisting of Fe and impurities; and having a recrystallized fraction being less than 90%.

12 Claims, 3 Drawing Sheets

FOREIGN PATENT DOCUMENTS

| | | |
|---|---|---|
| JP | 04-072904 | 3/1992 |
| JP | 06-330255 | 11/1994 |
| JP | 09-035925 | 2/1997 |
| JP | 10-212558 | 8/1998 |
| JP | 10-237606 | 9/1998 |
| JP | 2001-172752 | 6/2001 |
| JP | 2001-234302 | 8/2001 |
| JP | 2002-146493 | 5/2002 |
| JP | 2004-027278 | 1/2004 |
| JP | 2005-113185 | 4/2005 |
| JP | 2006-070348 | 3/2006 |
| JP | 2006-199999 | 8/2006 |
| JP | 2006-219692 | 8/2006 |

* cited by examiner

NON-ORIENTED ELECTRICAL STEEL SHEET AND PRODUCTION PROCESS THEREOF

CROSS-REFERENCE TO RELATED APPLICATIONS

This application is a continuation of U.S. patent application Ser. No. 11/988,296 filed Jan. 4, 2008, now U.S. Pat. No. 7,922,834 B2 issued Apr. 12, 2011, which is a 371 of PCT/JP2005/022368 filed Dec. 6, 2005, the disclosures of which are expressly incorporated by reference herein in their entireties.

TECHNICAL FIELD

The invention relates to a non-oriented electrical steel sheet used for a rotor of rotating machines such as generators and motors, in particular for a rotor of rotating machines required to have high efficiency such as a traction motor of electric and hybrid electric vehicles and a servo motor of robots and machine tools, and a production process thereof. Peculiarly, the invention relates to a non-oriented electrical steel sheet having excellent mechanical characteristics as well as magnetic characteristics that is suitable for a rotor of interior permanent magnet motors which rotate at a high speed, and a production process thereof.

BACKGROUND ART

Recently, energy saving technologies and environment protecting technologies have been advanced in various fields from the viewpoint of energy conservation and prevention of global warming. In the field of automobiles, technologies for reducing exhaust gases and for improving fuel efficiency are rapidly advancing. It is not too much to say that electric and hybrid electric vehicles are compilation of these technologies, and performance of the automobile is largely influenced by the performance of the traction motor of the automobile (simply referred to as "traction motor" hereinafter).

Most of the traction motors are composed of a stator having coiled wires and a rotor having permanent magnets. Recently, the rotor into which the permanent magnet embedded (interior permanent magnet motor; IPM motor) has been mainly used in traction motors. The rotational speed is arbitrarily controllable due to the progress of power electronic technologies, and the rotational speed tends to increase. Accordingly, core materials are mainly excited in a high frequency region, and the improvement of the magnetic characteristics not only at the commercial frequency (50 to 60 Hz) but also in a higher frequency region from 400 Hz to several kHz has been required. Furthermore, since the rotor always suffers from fluctuations of stress due to fluctuations of rotational speed as well as a centrifugal force by high rotational speed, the improvement of mechanical characteristics has been also required for the core material of the rotor. The shape of the rotor is complicated in the IPM motor. Therefore, mechanical characteristics enough for enduring the centrifugal force and fluctuations of stress are necessary for the core material of the rotor. In the future, the rotational speed would increase, in the field of servo motors for the robot and machine tool as in the field of traction motor.

Although the stator of the traction motor has been mainly produced by laminating punched non-oriented electrical steel sheets, the rotor has been produced by a lost-wax casting method or sintering method in some cases. This is because excellent magnetic characteristics are necessary for the stator, while tough mechanical characteristics are necessary for the rotor. However, since the performance of the motor is largely affected by an air-gap between the rotor and stator and then precise machining process is necessary for the rotor, the production cost of the rotor core has significantly increased. From the view point of reduction in the production cost, the punched electrical steel sheets may be used, but non-oriented electrical steel sheets having mechanical characteristics as well as magnetic characteristics necessary for the rotor have not been found yet.

Patent document 1 proposes, for example, an electrical steel sheet having excellent mechanical characteristics, characterized in that the steel sheet contains Si in the range from 3.5 to 7% as well as one or plural elements of Ti, W, Mo, Mn, Ni, Co and Al in the range not exceeding 20%. The strengthening mechanism of the steel proposed in patent document 1 is solid solution strengthening. However, the steel sheet strengthened mainly by solid solution strengthening would be broken during cold rolling step due to the deterioration of ductility before cold rolling, namely the steel sheet before cold rolling is also strengthened by solid solution strengthening. In addition, since a special process such as warm-rolling is inevitable, productivity and production yield still remain to be improved.

Patent document 2 discloses a steel sheet with a grain diameter of 30 μm or less containing from 2.0 to 3.5% of Si and from 0.1 to 6.0% of Mn as well as B and a large amount of Ni. The strengthening mechanism of the steel disclosed in patent document 2 is solid solution strengthening and strengthening through grain refinement. However, the strengthening effect through grain refinement exhibits a relatively small, so it is essential that the steel sheet contains about 3.0% of Si in addition to a large amount of Ni, which is quite expensive, as shown in the example in patent document 2. Accordingly, frequent breakages during cold rolling and the increase in the cost of alloying elements still remain.

Patent documents 3 and 4 propose a steel sheet containing from 2.0 to 4.0% of Si as well as Nb, Zr, B, Ti or V. The strengthening mechanism of the steel proposed in patent document 3 and 4 is precipitation strengthening by precipitations of Nb, Zr, Ti or V as well as solid solution strengthening by Si. However, strengthening effect by the precipitations exhibits a relatively small, so the steel sheet must contain about 3.0% of Si as shown in the examples in patent documents 3 and 4. Furthermore, the steel sheet must contain a large amount of Ni, which is quite expensive, in patent document 3. Accordingly, frequent breakages during cold rolling and the increase in the cost of alloying elements also remain.

Patent documents 5 and 6 propose a steel sheet containing: Ti, Nb and V; or P and Ni, while the amounts of Si and Al are restricted in the range from 0.03 to 0.5%. The strengthening mechanism of these steels is precipitation strengthening by carbides and solid solution strengthening by P rather than solid solution strengthening by Si. However, there remains a problem that an after-mentioned strength level necessary for the rotor of the traction motor cannot be ensured and a problem that an amount of Ni of 2.0% or more is essential as shown in examples in patent documents 5 and 6.

Patent document 7 proposes a non-oriented electrical steel sheet for the interior permanent magnet motor containing from 1.6 to 2.8% of Si with the specific grain diameter, thickness of the internal oxidation layer and yield point. However, the strength of the steel sheet having the yield point proposed in this document is insufficient for the rotor of the traction motor that rotates at a high speed.

Patent document 8 proposes a high strength electrical steel sheet having excellent magnetic characteristics. However, since this steel sheet is based on the concept maintaining the amount of Ti and Nb in an unavoidable impurity level or reducing the amount of Ti and Nb, high strength cannot be steadily obtained.

A so-called high-grade non-oriented electrical steel sheet (for example 35A210 and 35A230) has the largest amount of alloying element and the highest strength among the non-oriented electrical steel sheets prescribed in JIS C2552. However, mechanical characteristics of the high-grade non-oriented electrical steel sheet are below those of the above-mentioned high strength electrical steel sheet, and therefore the strength of the high-grade electrical steel sheet is insufficient for the rotor of the traction motor that rotates at a high speed.

Patent document 1: Japanese Patent Application Laid-Open (JP-A) No. 60-238421
Patent document 2: JP-A No. 1-162748
Patent document 3: JP-A No. 2-8346
Patent document 4: JP-A No. 6-330255
Patent document 5: JP-A No. 2001-234302
Patent document 6: JP-A No. 2002-146493
Patent document 7: JP-A No. 2001-172752
Patent document 8: JP-A No. 2005-113185

DISCLOSURE OF INVENTION

Problems to be solved by the invention

Since the steel sheet before cold rolling is also strengthened, frequent breakages during cold rolling are inevitable in the steel strengthened by solid solution strengthening and precipitation strengthening, which have been proposed in the related art as a strengthening method for the non-oriented electrical steel sheet. In addition, since the strengthening effect through grain refinement exhibits a relatively small, the strength necessary for the practical uses in rotor cannot be obtained. Furthermore, the inventors of the invention have investigated the effect of transformation strengthening, it has been found that core loss remarkably increases through transformation strengthening due to a transformed structure of martensite etc. Consequently, magnetic characteristics enough for practical uses as the rotor could not be obtained.

The motor efficiency will be improved by improving a space factor of the core. Therefore, it is preferable that surface characteristics of the steel sheet should be improved in terms of improvement of the space factor.

The invention has been made in view of the above-mentioned problems, and a main object thereof is to provide a non-oriented electrical steel sheet having excellent surface characteristics and having both excellent mechanical characteristics and magnetic characteristics necessary for a rotor of rotating machines such as motors and generators which rotate at a high speed, and a method for producing the same.

Means for Solving the Problems

The inventors of the invention have made various investigations into the structure of steel that is expected to be involved in the non-oriented electrical steel sheet having magnetic characteristics and mechanical characteristics suitable for the rotor, and have noticed strengthening by work hardening that had been seldom studied in electrical steel sheet. Then, it has been found that the effect of dislocations remaining in a recovery state on core loss is relatively small. Accordingly, it has been found that magnetic characteristics and mechanical characteristics necessary for the rotor are obtained by forming the structure of the steel sheet into a deformed structure and a structure of a recovery state (referred to as "recovery structure" hereinafter), in which many dislocations remains. Basically, the structure of the non-oriented electrical steel sheet in the related art has been fully-recrystallized ferrite grains. The technical concept of this invention is completely opposite to the concept of the non-oriented electrical steel sheet in the related art.

The invention has been achieved by further new knowledge that: the recovery structure may be steadily obtained by controlling the amounts of Nb, Zr, Ti and V within specific range; the surface characteristics of the non-oriented electrical steel sheet containing Nb, Zr, Ti and V may be steadily improved by controlling the cumulative rolling reduction ratio in roughing hot rolling and the equiaxed crystal ratios in the steel ingot or slab; and desired mechanical characteristics of the non-oriented electrical steel sheet containing Nb, Zr, Ti and V may be steadily obtained by controlling the tensile strength of the steel sheet before soaking treatment.

Namely, the invention provides a non-oriented electrical steel sheet comprising in % by mass: 0.06% or less of C; 3.5% or less of Si; from 0.05% or more to 3.0% or less of Mn; 2.5% or less of Al; 0.30% or less of P; 0.04% or less of S; 0.02% or less of N; at least one element selected from the group consisting of Nb, Ti, Zr and V in the range satisfying equation (1) below; as arbitrarily added elements, from 0% or more to 8.0% or less of Cu, from 0% or more to 2.0% or less of Ni, from 0% or more to 15.0% or less of Cr, from 0% or more to 4.0% or less of Mo, from 0% or more to 4.0% or less of Co, from 0% or more to 4.0% or less of W, from 0% or more to 0.5% or less of Sn, from 0% or more to 0.5% or less of Sb, from 0% or more to 0.3% or less of Se, from 0% or more to 0.2% or less of Bi, from 0% or more to 0.5% or less of Ge, from 0% or more to 0.3% or less of Te, from 0% or more to 0.01% or less of B, from 0% or more to 0.03% or less of Ca, from 0% or more to 0.02% or less of Mg and from 0% or more to 0.1% or less of REM; and a balance consisting of Fe and impurities; and having a recrystallized fraction being less than 90%;

$$0<Nb/93+Zr/91+Ti/48+V/51-(C/12+N/14)<5\times10^{-3} \quad (1)$$

(in equation (1), Nb, Zr, Ti, V, C and N represents the amounts (% by mass) of elements, respectively).

According to the invention, since the strength may be enhanced by forming the structure of the steel into a recovery structure, in which many dislocations remains, by controlling the recrystallized fraction within the specific range, a non-oriented electrical steel sheet having excellent mechanical characteristics and magnetic characteristics may be obtained. Good surface characteristics may also be ensured by prescribing the upper limit of the amounts of Nb, Ti, Zr and V according to equation (1). In other words, the above-mentioned steel structure as well as excellent surface characteristics may be steadily obtained by containing the above-mentioned chemical composition.

The non-oriented electrical steel sheet of the invention preferably contains more than 0.02% by mass of Nb. Since Nb has a large recrystallization suppressing effect among Nb, Zr, Ti and V, the above-mentioned steel structure may be steadily obtained.

Moreover, the non-oriented electrical steel sheet of the invention preferably comprises at least one element selected from the group consisting of Cu, Ni, Cr, Mo, Co and W in % by mass described below: from 0.01% or more to 8.0% or less of Cu; from 0.01% or more to 2.0% or less of Ni; from 0.01% or more to 15.0% or less of Cr; from 0.005% or more to 4.0% or less of Mo; from 0.01% or more to 4.0% or less of Co; and from 0.01% or more to 4.0% or less of W. The strength of the steel sheet may be further enhanced by the strength enhancing effect of the above-mentioned elements.

Furthermore, the non-oriented electrical steel sheet of the invention preferably comprises at least one element selected from the group consisting of Sn, Sb, Se, Bi, Ge, Te and B in % by mass described below: from 0.001% or more to 0.5% or less of Sn; from 0.0005% or more to 0.5% or less of Sb; from 0.0005% or more to 0.3% or less of Se; from 0.0005% or more to 0.2% or less of Bi; from 0.001% or more to 0.5% or less of Ge; from 0.0005% or more to 0.3% or less of Te; and from 0.0002% or more to 0.01% or less of B. Grain boundary segregation of the above-mentioned elements may effectively suppress recrystallization.

Still further, the non-oriented electrical steel sheet of the invention preferably comprises at least one element selected from the group consisting of Ca, Mg and REM in % by mass described below: from 0.0001% or more to 0.03% or less of Ca; from 0.0001% or more to 0.02% or less of Mg; and from 0.0001% or more to 0.1% or less of REM. The action for controlling sulfides dispersion of the above-mentioned elements may further improve magnetic characteristics.

The invention also provides a method for producing a non-oriented electrical steel sheet comprising the steps of: a hot rolling step for subjecting a steel ingot or slab having the above-mentioned chemical composition to hot rolling; a cold rolling step for subjecting a hot-rolled band obtained in the hot rolling step to one time of cold rolling or at least two times of cold rolling with intermediate annealing; and a soaking treatment step for soaking a cold-rolled steel sheet obtained in the cold rolling step at 820° C. or less.

According to the invention, recrystallization and the annihilation of dislocations introduced during cold rolling step are suppressed by properly controlling the amounts of Nb, Zr, Ti and V and adjusting the soaking temperature within a specific range. Therefore, a recovery structure in which many dislocations remains may be obtained, and then a non-oriented electrical steel sheet having higher strength may be obtained. Furthermore, a non-oriented electrical steel sheet having better magnetic characteristics as well as better mechanical characteristics may be obtained, by using the steel ingot or slab with a predetermined chemical composition. The surface characteristics of the steel sheet may be improved, by controlling the chemical composition within a predetermined range, hence the space factor of the rotor and moreover motor efficiency are improved. According to the invention as hitherto described, a non-oriented electrical steel sheet satisfying magnetic characteristics and mechanical characteristics necessary for the rotor of the traction motor and having good surface characteristics may be steadily produced, without using any expensive alloying elements and without applying special procedures as in the related art.

In the present invention, it is preferable that the hot rolling step includes a roughing hot rolling step for obtaining a bar by setting the steel ingot or slab at a temperature from 1100° C. or more to 1300° C. or less and then applying a roughing hot rolling with a cumulative rolling reduction ratio of 80% or more, and a finishing hot rolling step for subjecting the bar to a finishing hot rolling. It is also preferable that the temperature of the bar before the finishing hot rolling step should be 950° C. or more. Good surface characteristics may be steadily ensured, by applying the hot rolling step under a predetermined condition. Consequently, space factor may be improved.

It is preferable that the average equiaxed crystal ratio in the cross-section of the steel ingot or slab should be 25% or more. This is because the surface characteristics may be steadily improved.

In the present invention, it is preferable that the cold-rolled steel sheet with a thickness from 0.15 mm or more to 0.80 mm or less and a tensile strength of 850 MPa or more is produced in the cold rolling step. It is necessary to sufficiently introduce dislocations before the soaking treatment step, since the strengthening mechanism of the invention is to suppress the annihilation of dislocations which have been introduced before the soaking treatment step, as described above. Sufficient amount of dislocations may be introduced in the cold rolling step, by controlling the thickness of the cold-rolled steel sheet within a predetermined range. When the steel contains Nb, Zr, Ti and V, the amount of residual dislocations after soaking treatment step increases with an increase in the amount of dislocations introduced before soaking treatment step due to the suppression of the annihilation of dislocations during the soaking treatment, and thus the strength is improved. Therefore, the strength of the steel sheet before soaking treatment, namely the strength of as-cold-rolled steel sheet, for example tensile strength, indicates the amount of dislocations before soaking treatment. Accordingly, the amount of dislocations to be introduced in order to obtain high strength may be ensured in the steel containing Nb, Zr, Ti and V, by controlling the tensile strength of the steel sheet before the soaking treatment step, namely the tensile strength of the as-cold-rolled steel sheet, within a predetermined range. Hence, mechanical characteristics may be steadily improved.

The method for producing the non-oriented electrical steel sheet of the invention may include a hot-rolled band annealing step for subjecting the hot-rolled band to a hot-rolled band annealing. Breakage of the steel sheet during the cold rolling step may be suppressed due to the improvement of ductility of the steel sheet and excellent surface characteristics may be obtained, by applying the hot-rolled band annealing.

The invention also provides a rotor core formed by laminating the above-mentioned non-oriented electrical steel sheets. By using the rotor core of the invention for the motors, motor efficiency may be improved and the motor may stably operate due to the excellent mechanical and magnetic characteristics of the electrical steel sheet. By applying the rotor core of the invention to the generator, the generator may be rotate at a higher speed, and accordingly generation efficiency may be improved.

The invention also provides a rotating machine using the above-mentioned rotor core. Motor efficiency may be improved, and furthermore the motor may stably operate for a long period of time, by using the rotor core of the invention. Generation efficiency of the generator may also be improved.

Effect of the Invention

The invention provides the non-oriented electrical steel sheet having excellent mechanical characteristics and magnetic characteristics necessary for the rotor of the rotating machine that rotates at a high speed and having good surface characteristics without an increase in the production cost. Accordingly, the steel sheet of the invention may be suitable for the traction motors with high rotational speed for electric and hybrid electric vehicles. Therefore, the steel sheet of the invention has a quite high industrial value.

BEST MODE FOR CARRYING OUT THE INVENTION

Figure 1:
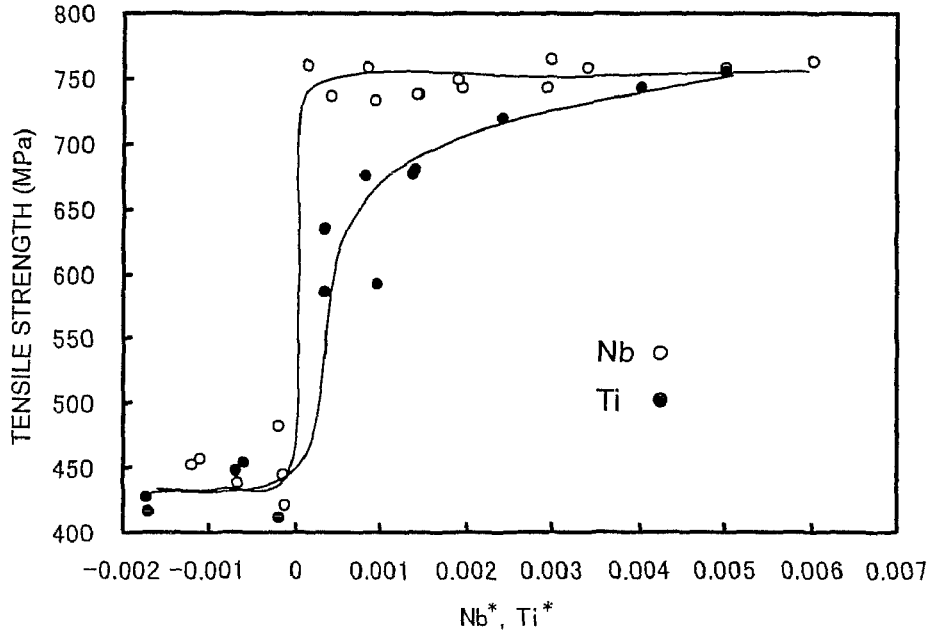
FIG. 1 is a graph showing the relations between Nb*(=Nb/93−C/12−N/14), Ti*(=Ti/48−C/12−N/14) and the tensile strength of the steel sheet after the soaking treatment step at 700° C. for 20 seconds.

The first characteristic necessary for the electrical steel sheet used for the rotor in the invention is mechanical characteristic, and refers to the yield point and tensile strength. This characteristic is related to suppression of fatigue fracture caused by fluctuations of stress as well as suppression of deformation of the rotor at high rotational speed. The rotor in the traction motor of recently developed electric and hybrid electric vehicles may operate under the stress condition as follows; stress amplitude is approximately 150 MPa and mean stress is approximately 250 MPa. Accordingly, the yield point is required to be 400 MPa or more in terms of suppression of deformation, and 500 MPa or more in terms of safety factor. It is preferable that the yield point should be 550 MPa or more. The tensile strength is required to be 550 MPa or more in terms of suppression of fatigue fracture under the stress condition as described above, 600 MPa or more in terms of safety factor, and preferably 700 MPa or more.

The second characteristic necessary for the electrical steel sheet used for the rotor is magnetic induction. In the motor such as the IPM motor that utilizes reluctance torque, the magnetic induction of the material used for the rotor core affects the torque, and consequently a desired torque should not be obtained if the magnetic induction of the rotor core material is low.

The third characteristic necessary for the electrical steel sheet used for the rotor is core loss. Core loss include hysteresis loss caused by irreversible motion of the magnetic domain wall and Joule heat (eddy current loss) by the eddy current generated by variation of magnetization, and core loss of the electrical steel sheet is evaluated by the total core loss as a sum of these losses. Although the motor efficiency would not directly deteriorate by core loss of rotor, it may influence the motor efficiency, because the permanent magnets embedded in the rotor core should deteriorate by rising of temperature due to the core loss of rotor. Accordingly, the upper limit of the core loss level of the material used for the rotor is determined in terms of thermal stability of the permanent magnet, and an allowable core loss level of the material used for the rotor may be higher than that of the material used for the stator.

The fourth characteristic necessary for the electrical steel sheet used for the rotor is surface characteristics. When the surface characteristics are poor, space factor of the laminated steel sheets would decrease. In other words, when the surface characteristics are poor, the magnetic induction per effective cross-sectional area decreases due to the decrease of the space factor. Consequently, the motor efficiency decreases, especially in IPM motor that utilizes reluctance torque. Here, the space factor means the ratio of the steel sheet in the core through thickness when the core is produced by laminating the non-oriented electrical steel sheets.

The inventors have made intensive investigation on the electrical steel sheet that satisfies these characteristics. At first, the effect of the structure and strengthening mechanism of the non-oriented electrical steel sheet on magnetic characteristics and mechanical characteristics has been investigated. As a result, it has been found that: breakages of the steel sheet during the cold rolling step in the steel sheet strengthened by solid solution strengthening and precipitation strengthening is inevitable, since the steel sheet before cold rolling is also strengthened by these strengthening mechanism; a required mechanical characteristics are not attained only by strengthening though grain refinement; and the core loss remarkably increases at a transformed structure such as martensite. Furthermore, it has been found that the effect of dislocations remaining in the recovery structure on the core loss is relatively small. It has been found from these results that magnetic characteristics and mechanical characteristics required for the rotor may be attained by forming recovery structure in which many dislocations remains. Basically, the structure of the non-oriented electrical steel sheet in the related art has been fully-recrystallized ferrite grains. The technical concept of this invention is completely opposite to the related art.

The deformed structure and recovery structure are obtained by suppressing the annihilation of dislocations, which are introduced by deforming the steel sheet into a predetermined thickness, during the soaking treatment step. Accordingly, the steel sheet before cold rolling is not strengthened by this strengthening mechanism, different from the related art in which solid solution strengthening and precipitation strengthening are dominant. Therefore, breakages of the steel sheet during the cold rolling step can be suppressed. For obtaining these deformed structure and recovery structure, annihilation of dislocations and recrystallization during the soaking treatment, which is usually applied after cold rolling for the purpose of recrystallization and grain growth, is required to be suppressed. Nb, Zr, Ti and V are necessary for suppressing the annihilation of dislocations and recrystallization during the soaking treatment step. It is preferable that a proper amount of Nb is dominantly contained, since contribution of Nb is large. It is also important to properly adjust the amounts of Nb, Zr, Ti and V, since the surface characteristics would deteriorate when the steel sheet contains excess amounts of Nb, Zr, Ti and V.

It is preferable that the hot rolling condition should be properly controlled in order to steadily improve the surface characteristics of the non-oriented electrical steel sheet containing Nb, Zr, Ti and V. Moreover, it is also preferable that the cold rolling condition should be properly controlled in order to steadily ensuring a desired strength.

Knowledge which has come up with the invention will be described hereinafter.

First, the results of the investigation into the effect of Nb, Zr, Ti and V on the mechanical characteristics and structure of the steel will be described.

A steel containing, in % by mass, 2.0% of Si, 0.2% of Mn, 0.3% of Al, 0.002% of N and 0.01% of P as major components in which the amounts of C, S and Nb were varied in the ranges from 0.001 to 0.04% for C, from 0.0002 to 0.03% for S and from 0.001 to 0.6% for Nb, and a steel containing, in % by mass, 2.0% of Si, 0.2% of Mn, 0.3% of Al, 0.002% of N and 0.01% of P as major components in which the amounts of C, S and Ti were varied in the range from 0.001 to 0.04% for C, from 0.0002 to 0.03% for S and from 0.001 to 0.3% for Ti were hot-rolled to 2.3 mm in thickness. The hot-rolled bands were annealed at 800° C. for 10 hours, and then they were cold-rolled to 0.35 mm in thickness. Cold-rolled sheets were soaked at 700° C. or 750° C. for 20 seconds. The tensile strength of the soaked steel sheets was measured.

Figure 2:
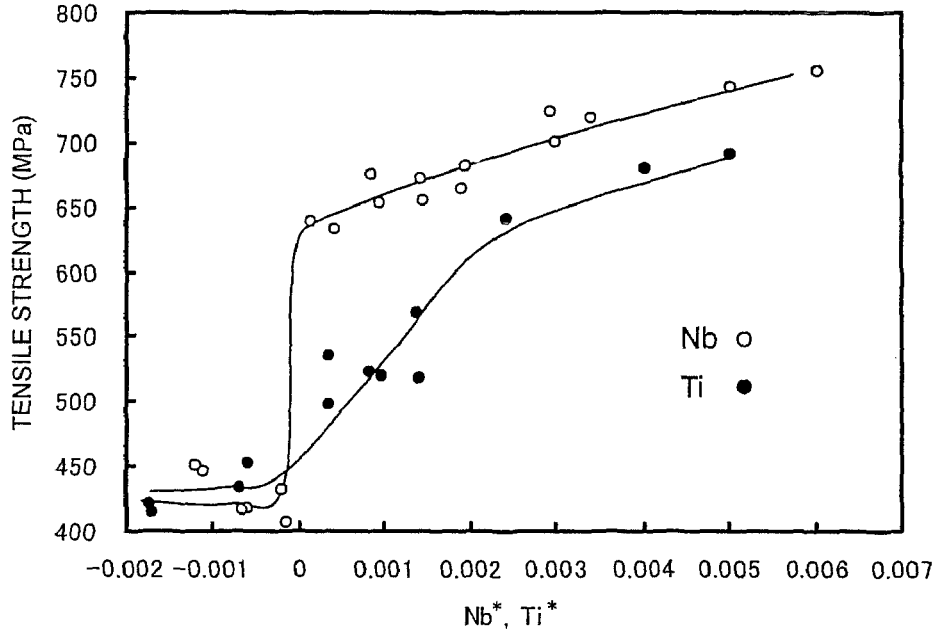
FIG. 2 is a graph showing the relations between Nb*(=Nb/93−C/12−N/14), Ti*(=Ti/48−C/12−N/14) and the tensile strength of the steel sheet after the soaking treatment step at 750° C. for 20 seconds.

FIGS. 1 and 2 show the relations between Nb*, Ti*, and the tensile strength of the steel sheets, respectively. Here, Nb* and Ti* are defined by the following equations (2) and (3), respectively:

$$Nb^*=Nb/93-C/12-N/14 \quad (2)$$

$$Ti^*=Ti/48-C/12-N/14 \quad (3)$$

(in equations (2) and (3), Nb, Ti, C and N show the amounts (% by mass) of elements, respectively).

FIGS. 1 and 2 show that excellent mechanical characteristics are obtained only when Nb*>0 and Ti*>0. From the investigation of the structure of the steel, recrystallization is suppressed only when Nb*>0 and Ti*>0, and the steel showed a deformed structure and recovery structure. Nb* and Ti* correspond to amounts of solute Nb and Ti, respectively, and it has been found that the amounts of the solute Nb and Ti is important for suppressing recrystallization. In comparison of Nb with Ti, Nb is more effective in strengthening of the steel than Ti, since recrystallization suppressing effect of Nb is larger than that of Ti. Moreover, it has been found that the soaking temperature rises, the difference of the recrystallization suppressing effect between Nb and Ti becomes larger.

The same investigation was performed for Zr and V, and accordingly it has been found that the following equation (1) is to be satisfied in order to suppress recrystallization by combining the above-mentioned discoveries.

$$0<Nb/93+Zr/91+Ti/48+V/51-(C/12+N/14)<5\times10^{-3} \quad (1)$$

(in equation (1), Nb, Zr, Ti, V, C and N show the amounts (% by mass) of elements, respectively)

Secondly, the results of the investigation into the method for improving surface characteristics in the non-oriented electrical steel sheet containing Nb, Zr, Ti and V will be described.

Molten steel (230 tons) after decarburization and desulfurization in a converter was tapped out into a ladle. The ladle was transferred into an RH type vacuum degassing apparatus. The molten steel was decarburized in the RH type vacuum degassing apparatus, and the molten steel having the chemical composition shown in Table 1 was cast into slab with a continuous casting apparatus. The average equiaxed crystal ratio in the slab was from 0 to 30%.

TABLE 1

| | Steel composition (% by mass) | | | | | | | |
|---|---|---|---|---|---|---|---|---|
| Steel | C | Si | Mn | P | S | Al | N | Nb |
| 1 | 0.002 | 3.0 | 0.2 | 0.01 | 0.002 | 1.1 | 0.002 | 0.001 |
| 2 | 0.002 | 2.9 | 0.2 | 0.01 | 0.002 | 1.2 | 0.002 | 0.04 |
| 3 | 0.002 | 2.9 | 0.2 | 0.01 | 0.002 | 1.2 | 0.002 | 0.09 |

These slabs were heated at 1150° C. in a heating furnace. Then, they were rolled by the roughing hot rolling mill at a cumulative rolling reduction ratio from 77 to 86%, and were rolled to 2.0 mm in thickness by the finishing hot rolling mill at a finishing temperature from 800 to 850° C. and at a coiling temperature of 500° C. The hot-rolled bands were annealed at 750° C. for 10 hours, and then they were cold-rolled to a thickness of 0.35 mm. The cold-rolled steel sheets were soaked at 760° C. for 20 seconds, and an insulation coating with an average thickness of 0.5 μm was formed on the surface of each of the steel sheets. Specimens were sampled from each of the steel sheets according to JIS C2550, and the space factor, magnetic characteristics (core loss $W_{10/400}$) and mechanical characteristics (yield point YP, tensile strength TS) were measured. The results are shown in Table 2.

The equiaxed crystal ratio was measured at 3 positions of the slab (1/4, 2/4, 3/4 in slab width) from the macroscopic structure of cross-section perpendicular to casting direction, and then measured values were averaged.

The cumulative rolling reduction ratio in the roughing hot rolling mill (cumulative rolling reduction ratio in roughing rolling) was calculated from the thickness A of the slab at the inlet side of the roughing hot rolling mill and the thickness B of the bar at the outlet side of the roughing hot rolling mill by the following equation:

$$(1-B/A)\times100(\%)$$

The space factor was evaluated as "A" when the value is 98% or more, as "B" when it is from 95% or more to less than 98% and as "C" when it is less than 95%, and the steels of "A" and "B" were determined to be applicable as the rotor core.

TABLE 2

| Steel | Product No. | Average equiaxed crystal ratio (%) | Cumulative rolling reduction ratio in roughing rolling (%) | Temperature at outlet side of roughing rolling (° C.) | Evaluation of space factor | $W_{10/400}$ (W/kg) | YP (MPa) | TS (MPa) |
|---|---|---|---|---|---|---|---|---|
| 1 | 1 | <10 | 77 | 1000 | B | 29 | 356 | 459 |
| | 2 | <10 | 86 | 970 | A | 28 | 361 | 465 |
| | 3 | <10 | 86 | 940 | B | 28 | 355 | 458 |
| | 4 | 30 | 77 | 990 | A | 29 | 368 | 469 |
| | 5 | 30 | 86 | 970 | A | 28 | 366 | 459 |
| | 6 | 30 | 83 | 980 | A | 29 | 371 | 467 |
| 2 | 7 | <10 | 77 | 1010 | C | 32 | 525 | 675 |
| | 8 | <10 | 86 | 990 | B | 33 | 520 | 680 |
| | 9 | <10 | 86 | 930 | C | 32 | 523 | 678 |
| | 10 | 30 | 77 | 1020 | C | 32 | 536 | 684 |
| | 11 | 30 | 86 | 980 | A | 31 | 530 | 686 |
| | 12 | 30 | 83 | 980 | A | 32 | 530 | 681 |
| 3 | 13 | <10 | 77 | 1010 | C | 36 | 600 | 709 |
| | 14 | <10 | 86 | 980 | B | 35 | 605 | 701 |
| | 15 | <10 | 86 | 930 | C | 36 | 608 | 705 |
| | 16 | 30 | 77 | 990 | C | 36 | 611 | 711 |
| | 17 | 50 | 86 | 950 | A | 35 | 605 | 712 |
| | 18 | 50 | 83 | 980 | A | 35 | 605 | 714 |

The conventional non-oriented electrical steel sheet containing almost no Nb (steel 1) shows a high space factor irrespective of the hot rolling conditions. However, the non-oriented electrical steel sheets containing a predetermined amount of Nb (steels 2 and 3) show a high space factor when the cumulative rolling reduction ratio in the roughing hot rolling mill is 80% or more and the temperature at the outlet side of the roughing hot rolling mill is 95° C. or more. It has been also found that: the space factor is further improved by increasing in the value of average equiaxed crystal ratio in the slab; and the effect of the hot rolling condition on the mechanical characteristics and magnetic characteristics is smaller than the effect on the space factor.

The same investigations as described above were carried out for Ti, Zr and V, and it has been found that properly control of the hot rolling conditions and average equiaxed crystal ratio in the slab is effective in enhancing the space factor of the non-oriented electrical steel sheet containing Nb, Zr, Ti and V. The mechanism of the effect has not been clarified yet, but the inventors presume as follows.

The improvement of the space factor is due to the improvement of the surface characteristics. Although recrystallization during soaking treatment is suppressed, recrystallization during hot rolling and hot-rolled band annealing may also be suppressed in the steel containing Nb, Zr, Ti and V. Consequently, rough defects on the surface after cold rolling due to giant columnar grains in the cast structure may be enhanced. This surface defects seem to cause a decrease in the space factor. On the contrary, recrystallization during hot rolling may be accelerated by enhancing both the cumulative rolling reduction ratio in the roughing hot rolling and the temperature at the outlet side of the roughing hot rolling mill in the process of the invention, and therefore a linear band structure parallel to the rolling direction caused by the giant columnar grains in the cast structure seems to be annihilated. Accordingly, the surface defect after cold rolling may be suppressed, and then the space factor may be improved.

Next, the result of the investigation into the method for steadily enhancing mechanical characteristics of the steel containing Nb, Zr, Ti and V will be described.

A steel (the steel with Nb*<0) containing, in % by mass, 0.003% of C, 2.9% of Si, 0.2% of Mn, 1.1% of Al, 0.001% of S, 0.002% of N, 0.01% of P and 0.001% of Nb with a balance of Fe and impurities, and a steel (the steel with Nb*>0) containing 0.002% of C, 2.8% of Si, 0.2% of Mn, 1.2% of Al, 0.006% of S, 0.002% of N, 0.01% of P and 0.09% of Nb with a balance of Fe and impurities were hot-rolled to a thickness of 2.0 mm. Hot-rolled bands were annealed at 750° C. for 10 hours, and then they were cold-rolled to a various thickness from 0.35 to 1.2 mm by one time of cold rolling. After the hot-rolled band annealing, some of the hot-rolled bands were cold-rolled to a thickness of 0.35 mm by two times of cold rolling with an intermediate thickness from 0.4 to 1.8 mm and an intermediate annealing of 750° C. for 10 hours. These cold-rolled sheets were soaked at 700° C. for 20 seconds. The tensile test was performed for these steel sheets before and after the soaking treatment. Here, the longitudinal direction of the specimens was parallel to the rolling direction.

Figure 3:
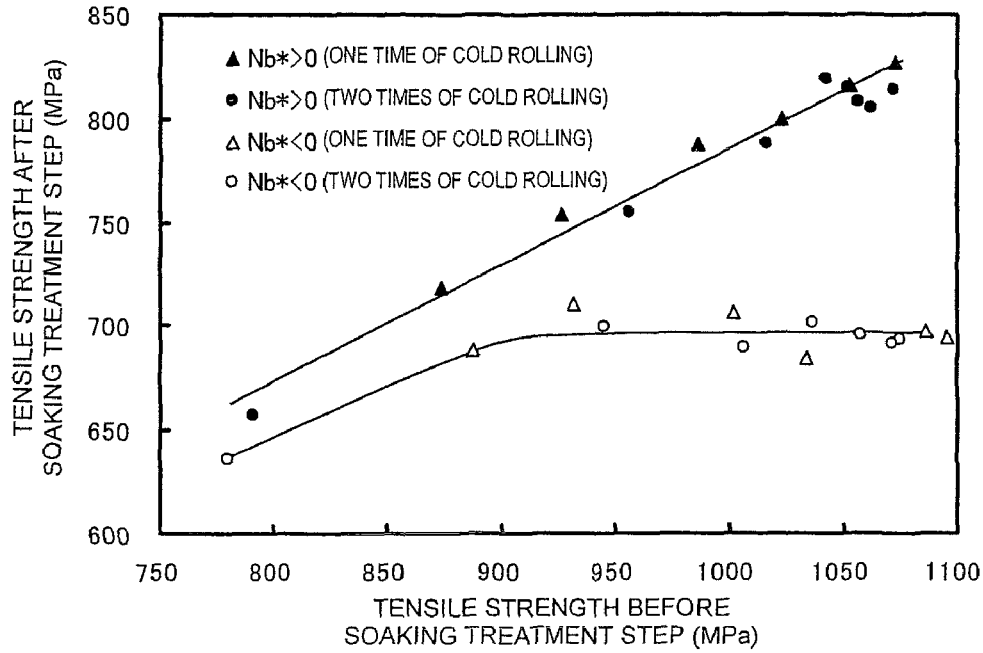
FIG. 3 is a graph showing the relations of the tensile strength before and after the soaking treatment step.
Figure 4:
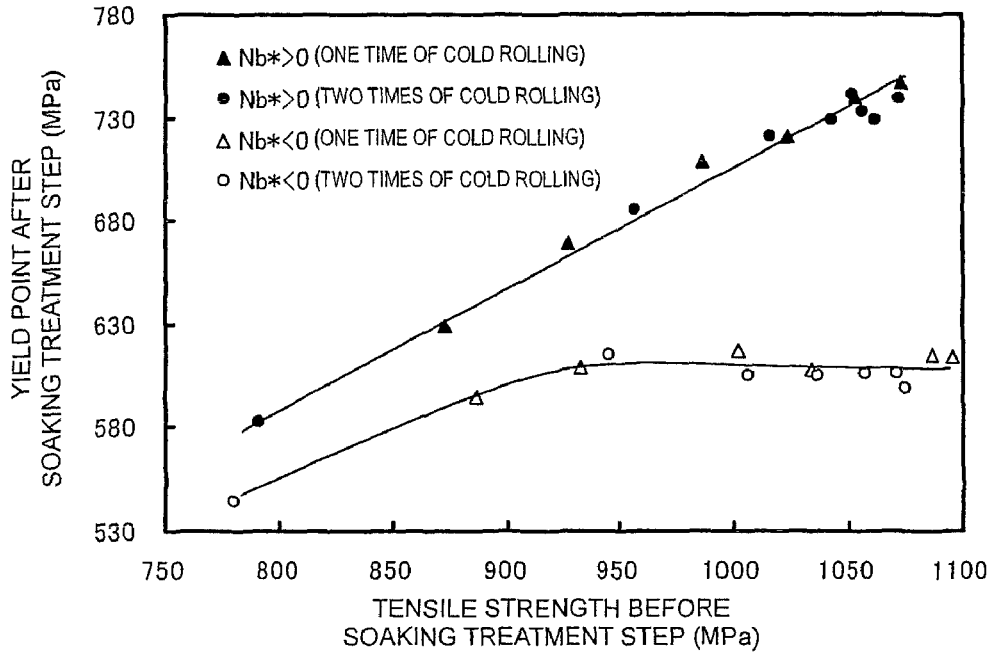
FIG. 4 is a graph showing the relations between the tensile strength before the soaking treatment step and the yield point after the soaking treatment step.

FIG. 3 shows the relations between the tensile strength before and after the soaking treatment step. FIG. 4 shows the relations between the tensile strength before the soaking treatment step and the yield point after the soaking treatment step. It has been found from FIG. 3 that the tensile strength after the soaking treatment step increases with an increase in the tensile strength before the soaking treatment step, namely the tensile strength of as-cold-rolled steel sheets, irrespective of the number of steps for cold rolling, only in the steel with Nb*>0. FIG. 4 also shows that the yield point after soaking treatment step increases with an increase in the tensile strength before the soaking treatment step, namely the tensile strength of as-cold-rolled steel sheets, irrespective of the number of steps for cold rolling, only in the steel with Nb*>0.

The tensile strength of as-cold-rolled steel sheets indicates the amounts of dislocations introduced before cold rolling and by cold rolling, namely it indicates the amounts of dislocations before the soaking treatment step. The strengthening mechanism of the invention is to suppress the annihilation of dislocations, which are introduced before the soaking treatment step, during soaking treatment. Accordingly, it is necessary that a large amount of dislocations should be introduced before the soaking treatment step, namely, it is important that a large amount of dislocations should be introduced during the cold rolling step in order to leave a sufficient amount of dislocations after the soaking treatment step.

However, the annihilation of dislocations during the soaking treatment step would not be suppressed in the steel containing almost no solute Nb (steel with Nb*<0). Therefore, the dislocation of the steel with Nb*<0 would not remain after the soaking treatment step even if large amounts of dislocations are introduced before soaking treatment step, namely even if the tensile strength of the as-cold-rolled steel sheet is enhanced. Then, sufficient strength would not be obtained in the steel with Nb*<0. On the contrary, the annihilation of dislocations during the soaking treatment step is suppressed in the steel containing solute Nb (steel with Nb*>0). Therefore, the dislocations of the steel with Nb*>0 remain after the soaking treatment step. The amount of dislocation which remains after the soaking treatment step increases with an increase in the amount of dislocations introduced before the soaking treatment step, namely with an increase in the value of tensile strength before the soaking treatment step. Then, the strength may be steadily ensured after the soaking treatment step in the steel with Nb*>0. Accordingly, the tensile strength before the soaking treatment step may be used as a criterion of the amount of dislocations to be introduced necessary for ensuring the strength such as the tensile strength and yield point of the steel sheet after the soaking treatment step in the steel containing solute Nb (steel with Nb*>0).

The same investigations were performed on Ti, Zr and V, and it has been found that the tensile strength before the soaking treatment step may be used as an index of the strength such as the tensile strength and yield point after soaking treatment step, since the annihilation of dislocations during the soaking treatment step is suppressed in the steel having the chemical composition of the invention.

It has been also found that a tensile strength of 850 MPa or more before the soaking treatment step is necessary for ensuring sufficient strength such as tensile strength and yield point after the soaking treatment step.

The invention has been achieved by the discoveries described above.

Hereinafter, the non-oriented electrical steel sheet of the invention and the production method thereof, and the rotor core and rotating machine will be described in detail below.

A. Non-oriented Electrical Steel Sheet

The non-oriented electrical steel sheet of the invention comprises in % by mass: 0.06% or less of C; 3.5% or less of Si; from 0.05% or more to 3.0% or less of Mn; 2.5% or less of Al; 0.30% or less of P; 0.04% or less of S; 0.02% or less of N; at least one element selected from the group consisting of Nb, Ti, Zr and V in a range satisfying equation (1) below; as arbitrarily added elements, from 0% or more to 8.0% or less of Cu, from 0% or more to 2.0% or less of Ni, from 0% or more to 15.0% or less of Cr, from 0% or more to 4.0% or less of Mo, from 0% or more to 4.0% or less of Co, from 0% or more to 4.0% or less of W, from 0% or more to 0.5% or less of Sn, from 0% or more to 0.5% or less of Sb, from 0% or more to 0.3% or less of Se, from 0% or more to 0.2% or less of Bi, from 0% or more to 0.5% or less of Ge, from 0% or more to 0.3% or less of Te, from 0% or more to 0.01% or less of B, from 0% or more to 0.03% or less of Ca, from 0% or more to 0.02% or less of Mg and from 0% or more to 0.1% or less of REM; and a balance consisting of Fe and impurities; and has a recrystallized fraction being less than 90%.

$$0<Nb/93+Zr/91+Ti/48+V/51-(C/12+N/14)<5\times10^{-3} \quad (1)$$

(in equation (1), Nb, Zr, Ti, V, C and N denote the amounts (% by mass) of elements, respectively)

"%" that denotes the amount of each element means "% by mass" unless otherwise stated. The phrase "a balance consisting of Fe and impurities" means that other elements may also be contained in the range not impairing the effect of the invention.

The chemical composition and the recrystallized fraction of the non-oriented electrical steel sheet of the invention will be described below.

1. Chemical Composition (1) C

Since C forms precipitations with Nb, Zr, Ti or V, it causes reduction of the amounts of solute Nb, Zr, Ti and V. Accordingly, it is preferable that the amount of C should be reduced in order to suppress the annihilation of dislocations and recrystallization during the soaking treatment step. However, the upper limit of C is defined to be 0.06%, by considering that: the production cost of the steel increase through the excessive reduction of the amount of C; and the amounts of solute Nb, Zr, Ti and V may be ensured by an increase in the amounts of Nb, Zr, Ti and V in response to the increase in the amount of C. It is preferable that the amount of C should be 0.04% or less, more preferably 0.02% or less. An amount of C of 0.01% or less is desirable in terms of the production cost, since the amounts of Nb, Zr, Ti and V necessary for satisfying the relation of [Nb/93+Zr/91+Ti/48+V/51−(C/12+N/14)>0] may be reduced.

(2) Si

Electrical resistivity increases with an increase in the amount of Si. Therefore, eddy current loss decrease with an increase in the amount of Si. However, too large amount of Si induces breakages during cold rolling, and the production cost increases due to the reduction of production yield of the steel sheet. Accordingly, the amount of Si is 3.5% or less, and preferably 3.0% or less in view of suppression of breakages during cold rolling. Although the amount of Si of 0.01% or more is necessary as a deoxidizer, the lower limit of the amount of Si is not particularly restricted, since Al may also be used as the deoxidizer. The desirable lower limit of Si is 1.0% in terms of improvement of mechanical characteristics by solid solution strengthening.

(3) Mn

Electrical resistivity increases with an increase in the amount of Mn. Therefore, eddy current loss decrease with an increase in the amount of Mn. However, the alloying cost increases by a large amount of Mn. Accordingly, the upper limit of the Mn amount is 3.0%. The lower limit of the Mn amount is 0.05%, in terms of fixing of S.

(4) Al

Electrical resistivity increases with an increase in the amount of Al. Therefore, eddy current loss decrease with an increase in the amount of Al. However, the alloying cost increases by a large amount of Al, and moreover motor efficiency decreases due to the decrease in saturation magnetization. The upper limit of the amount of Al is 2.5% in terms of the above-mentioned effects. Although an amount of Al of 0.01% or more is necessary as the deoxidizer, the lower limit of the amount of Al is not particularly restricted, since Si may also be used as the deoxidizer. The desirable lower limit of Al is 0.2% in terms of improvement of mechanical characteristics by solid solution strengthening.

(5) P

Although P is effective in strengthening of the steel sheet by solid solution strengthening, a large amount of P may cause breakages during the cold rolling step. Accordingly, the amount of P is restricted to 0.30% or less.

(6) S

S is an unavoidable impurity in the steel. The upper limit of the S amount is 0.04%, since the production cost in the steel making process increase with reducing the amount of S.

(7) N

Since N forms a precipitation with Nb, Zr, Ti or V, it causes the reduction of the amount of solute Nb, Zr, Ti or V. Accordingly, it is preferable that the amount of N should be reduced in order to suppress the annihilation of dislocations and recrystallization by solute Nb, Zr, Ti or V. However, the upper limit of the amount of N is determined to be 0.02%, since the amount of solute Nb, Zr, Ti or V may be ensured by an increase in the amount of Nb, Zr, Ti or V in response to the increase in the amount of N. The amount of N is preferably 0.01% or less, more preferably 0.005% or less. The amount of N is desirably 0.005% or less in terms of reduction of the production cost, since the amounts of Nb, Zr, Ti and V necessary for satisfying the relation of [Nb/93+Zr/91+Ti/48+V/51−(C/12+N/14)>0] may be reduced.

(8) Nb, Zr, Ti and V

It is necessary that the steel sheet contains solute Nb, Zr, Ti or V in order to obtain mechanical characteristics and magnetic characteristics necessary for the rotor, by suppressing annihilation of dislocations and recrystallization during the soaking treatment step and forming deformed structure and recovery structure. Accordingly, it is necessary that the steel sheet contains at least one element selected from the group consisting of Nb, Zr, Ti and V in the range satisfying the following relation (4):

$$Nb/93+Zr/91+Ti/48+V/51-(C/12+N/14)>0 \quad (4)$$

(in the equation (4), Nb, Zr, Ti, V, C and N denote the amounts (% by mass) of elements, respectively)

The left side of equation (4) represents the difference between the amounts of Nb, Zr, Ti and V and the amounts of C and N, and a positive value of the difference corresponds to the state in which the steel contains solute Nb, Zr, Ti or V which do not form precipitations such as carbides, nitrides or carbonitrides.

It is preferable that the steel sheet purposely contains Nb or Ti, since solute Nb or Ti has a large recrystallization suppressing effect among the above-mentioned elements. In particular, it is preferable that the steel sheet purposely contains Nb, since the contribution of solute Nb in suppression of recrystallization is larger than that of Ti. Solute Nb greatly contributes to the improvement of productivity as will be described later. The amount of Nb preferably exceeds 0.02%, and is more preferably 0.03% or more, further preferably 0.04% or more. The amount of Ti preferably exceeds 0.01%, and is more preferably 0.02% or more. On the other hand, the upper limit of Nb and Ti is in the range not exceeding the range defined by equation (1) described below.

As shown in FIGS. 1 and 2, the effect for suppressing the annihilation of dislocations and recrystallization increases with an increase in the amounts of solute Nb, Zr, Ti and V at the high soaking temperature. Therefore, the larger amounts of these solute elements are effective in obtaining deformed structure or recovery structure.

However, since the annihilation of dislocations and recrystallization are suppressed during hot rolling and the hot-rolled band annealing in the steel sheet containing too large amount of solute Nb, Zr, Ti and V, the structure before cold rolling may be in a deformed state. Asa result, surface defects, called as ridging, are occurred. The surface defects are not preferable, since the efficiency of the motor decreases due to decrease in the space factor. Furthermore, the steel sheet containing too large amount of solute Nb, Zr, Ti and V may be broken during cold rolling. The upper limit of solute Nb, Zr, Ti and V maybe determined in terms of suppression of deterioration of surface characteristics and suppression of breakages during cold rolling. Hence, the amounts of Nb, Zr, Ti and V are to be in the range indicated by equation (1) below:

$$0<Nb/93+Zr/91+Ti/48+V/51-(C/12+N/14)<5\times10^{-3} \quad (1)$$

(in equation (1), Nb, Zr, Ti, V, C and N denote the amounts (% by mass) of elements, respectively)

The amounts of solute Nb, Zr, Ti and V should be also affected by the amount of S in consideration of sulfide. However, since no effect of S on the suppression of recrystallization was observed in the range of the above-mentioned S amount, the amount of S is omitted in equation (1) in the invention. While the mechanism of these results about S has not been clarified yet, it would seem that S is fixed by Mn through the crystallization of MnS in S-enriched region at the end of solidification.

(9) Cu, Ni, Cr, Mo Co and W

The excellent magnetic characteristics and mechanical characteristics are obtained by suppressing recrystallization in the invention. Consequently, the steel sheet may contain at least one element selected from the group consisting of Cu, Ni, Cr, Mo, Co and W in the range not impairing the recrystallization suppressing effect. These elements are effective and preferable in further enhancing the strength of the steel sheet, since they have a function for strengthening the steel sheet.

Electrical resistivity increases with an increase in the amount of Cu. Therefore, eddy current loss decrease with an increase in the amount of Cu. However, a too large amount of Cu induces surface flaw and breakages during cold rolling. Consequently, the amount of Cu is preferably from 0.01% or more to 8.0% or less, and 1.0% or less in terms of suppressing the surface flaw.

Too large amounts of Ni and Mo induce breakages during cold rolling and result in an increase in the production cost. Accordingly, the amount of Ni is preferably from 0.01% or more to 2.0% or less, and the amount of Mo is preferably from 0.005% or more to 4.0% or less.

Electrical resistivity increases with an increase in the amount of Cr. Therefore, eddy current loss decrease with an increase in the amount of Cr. In addition, Cr improves the corrosion resistance. However, a too large amount of Cr causes an increase in the alloying cost. Therefore, the amount of Cr is preferably from 0.01% or more to 15.0% or less.

Too large amounts of Co and W cause an increase in the alloying cost. Consequently, the amount of Co is preferably from 0.01% or more to 4.0% or less, and the amount of W is preferably from 0.01% or more to 4.0% or less.

(10) Sn, Sb, Se, Bi, Ge, Te and B

In the invention, excellent magnetic characteristics and mechanical characteristics are obtained by suppressing recrystallization. Accordingly, the steel sheet preferably contains at least one element selected from the group consisting of Sn, Sb, Se, Bi, Ge, Te and B having an effect for suppressing recrystallization by grain boundary segregation. The amount of each element is preferably 0.5% or less for Sn, 0.5% or less for Sb, 0.3% or less for Se, 0.2% or less for Bi, 0.5% or less for Ge, 0.3% or less for Te and 0.01% or less for B in terms of suppressing of breakages during the hot rolling step and suppressing of an increase in the production cost. The amount of each element is preferably 0.001% or more for Sn, 0.0005% or more for Sb, 0.0005% or more for Se, 0.0005% or more for Bi, 0.001% or more for Ge, 0.0005% or more for Te and 0.0002% or more for B in order to steadily obtain the recrystallization suppressing effect by these elements.

(11) Ca, Mg and REM

In the invention, no effect of S on the suppression of the recrystallization was observed in the range of the amount of S described-above. Accordingly, the steel sheet may contain at least one element selected from the group consisting of Ca, Mg and REM for improving magnetic characteristics by controlling sulfides dispersion.

Here, REM indicates 17 elements. They are 15 elements with atomic numbers from 57 to 71 and two elements of Sc and Y.

The amount of each element is preferably 0.03% or less for Ca, 0.02% or less for Mg and 0.1% or less for REM. The amount of each element is preferably 0.0001% or more for Ca, 0.0001% or more for Mg and 0.0001% or more for REM in order to steadily obtain the above-mentioned effect.

(12) Other Elements

In the invention, the steel sheet may contain elements other than the above-mentioned elements in the range not impairing the effect of the invention. Unlike the related art based on the fully-recrystallized structure, the invention provides a steel sheet strengthened by forming deformed structure and recovery structure having many residual dislocations. Accordingly, the amounts of elements which have been restricted in the related art based on the fully-recrystallized structure may be accepted up to higher levels. For example, the steel sheet may contain Ta, Hf, As, Au, Be, Zn, Pb, Tc, Re, Ru, Os, Rh, Ir, Pd, Pt, Ag, Cd, Hg and Po in a total amount of 0.1% or less.

2. Recrystallized Fraction

Next, the reason of restricting the recrystallized fraction in the invention will be described below based on the experimental results.

A steel containing, in % by mass, 0.002% of C, 2.8% of Si, 0.2% of Mn, 1.2% of Al, 0.006% of S, 0.002% of N, 0.01% of P and 0.09% of Nb was hot-rolled to a thickness of 2.3 mm. Hot-rolled bands were annealed at 800° C. for 10 hours, and then cold-rolled to a thickness of 0.35 mm. Cold-rolled steel sheets were soaked at various temperatures from 680 to 1050° C. for 10 seconds. The tensile strength of the soaked steel sheet was measured.

Figure 5:
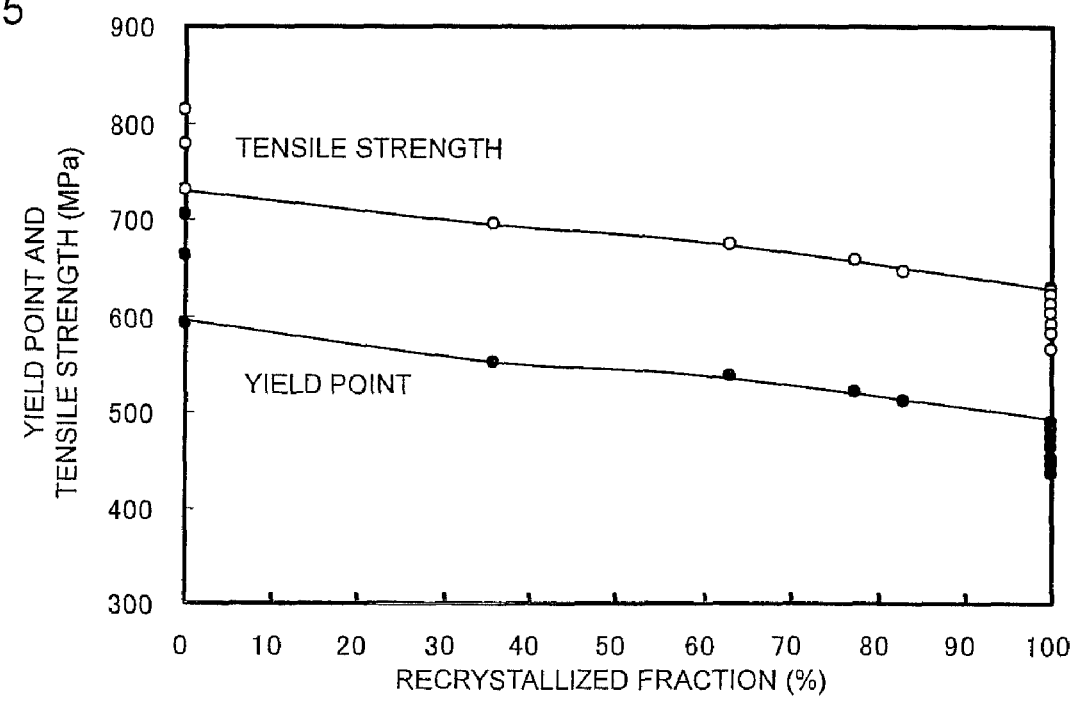
FIG. 5 is a graph showing the relations between the yield point, tensile strength and the recrystallized fraction.

FIG. 5 shows the relations between the yield point, tensile strength and the recrystallized fraction. While the recrystallized fraction remains zero, the yield point and tensile strength decrease with the advance of recovery, which is precursor stage of recrystallization. After starting recrystallization, the yield point and tensile strength further decrease with an increase in the recrystallized fraction. The recrystallized fraction is determined in terms of ensuring mechanical characteristics necessary for the rotor. The recrystallized fraction is less than 90%, preferably 70% or less, from the view point of suppression of deformation at high rotational speed in consideration of safety factor. The recrystallized fraction is preferably 40% or less, more preferably less than 25%, in terms of suppressing of fatigue fracture. The lower is preferable the recrystallized fraction in terms of mechanical characteristics, and the recrystallized fraction is preferably zero in order to form completely non-recrystallized state (deformed structure and recovery structure).

Temperature and time during the soaking treatment step are quite important for controlling the recrystallized fraction. The recrystallized fraction may be more easily controlled when the steel sheet purposely contains Nb. Because the effect of Nb on the suppression of recrystallization is much larger than Ti, Zr and V. As a result, productivity may be improved.

Here, the recrystallized fraction is the ratio of the area of recrystallized grains to total area on a photograph of a vertical cross-section of the steel sheet. An optical microscopic photograph at a magnification of, for example, 100 may be used.

B. Method for Producing Non-oriented Electrical Steel Sheet of the Invention

Next, the method for producing non-oriented electrical steel sheet of the invention will be described.

The method for producing non-oriented electrical steel sheet of the invention comprises the steps of: a hot rolling step for subjecting a steel ingot or slab having the above-mentioned chemical composition to hot rolling; a cold rolling step for subjecting a hot-rolled band obtained in the hot rolling step to one time of cold rolling or at least two times of cold rolling with intermediate annealing; and a soaking treatment step for soaking a cold-rolled steel sheet obtained in the cold rolling step at 820° C. or less.

Each step in the method for producing the non-oriented electrical steel sheet will be described hereinafter.

1. Hot Rolling Step

The steel ingot or slab having the above-mentioned chemical composition (referred to as "slab" hereinafter) is subjected to hot rolling in the hot rolling step of in the invention.

Descriptions of the chemical composition of the steel ingot or slab are omitted herein, since they are the same as those described in "A. Non-oriented electrical steel sheet".

The condition of hot rolling step of the invention is not particularly restricted, so long as the steel ingot or slab having the above-mentioned chemical composition is hot-rolled. While ordinary hot rolling conditions may be acceptable, the hot rolling step preferably includes: a roughing hot rolling step for obtaining a bar by setting the steel ingot or slab at a temperature from 1100° C. or more to 1300° C. or less and then applying a roughing hot rolling at a cumulative rolling reduction ratio of 80% or more; and a finishing hot rolling step for subjecting the bar to a finishing hot rolling. It is preferable that the temperature of the bar before the finishing hot rolling step should be 950° C. or more.

When the ordinary hot rolling conditions are applied in hot rolling step, the steel having the above-mentioned chemical composition is formed into a slab by ordinary methods such as a continuous casting method or a blooming method of the ingot, and then the slab is inserted into a heating furnace and hot-rolled. The slab may be directly hot-rolled without inserting into the heating furnace when the temperature of the slab is high.

While the temperature of slab is not particularly restricted, the temperature of slab is preferably from 1000 to 1300° C., more preferably from 1050 to 1250° C., in terms of the production cost and hot ductility.

The other conditions of hot rolling are not particularly restricted, and ordinary conditions such as a finishing temperature from 700 to 950° C. and a coiling temperature of 750° C. or less may be acceptable.

On the other hand, when the temperature of the bar before the finishing hot rolling step is 950° C. or more in hot rolling, the following conditions are preferable. The favorable aspect of the hot rolling step will be described below.

(1) Roughing Hot Rolling Step

In the roughing hot rolling step of the invention, the steel ingot or slab having the above-mentioned chemical composition is set at a temperature from 1100° C. or more to 1300° C. or less, and is subjected to the roughing hot rolling at the cumulative rolling reduction ratio of 80% or more.

The steel having the above-mentioned chemical composition is formed into a slab by ordinary methods such as the continuous casting method or blooming method of the ingot, and the slab is heated at a predetermined temperature and subjected to the roughing hot rolling. A method for inserting the slab into the heating furnace and heating the slab at a predetermined temperature as well as a method for subjecting the slab to a direct roughing hot rolling without inserting into the heating furnace may be used, so long as a predetermined temperature is ensured.

The temperature of slab before the roughing hot rolling is preferably from 1100° C. or more to 1300° C. or less. If the slab temperature is lower than the above-mentioned range, recrystallization during the hot rolling step may be insufficient, and therefore surface defects as described above may appear on the steel sheet after cold rolling. Moreover, if the slab temperature exceeds the above-mentioned range, it may be difficult to form the slab into a predetermined shape by hot rolling due to the deformation of the slab during heating. The more preferable slab temperature is from 1100 to 1250° C.

The average equiaxed crystal ratio in the cross-section of the slab is preferably 25% or more, since the surface characteristics may be further improved. The average equiaxed crystal ratio may be controlled by ordinary methods such as electromagnetic stirring during the continuous casting.

Here, the equiaxed crystal ratio is a ratio of the thickness of the equiaxed crystal portion to the thickness of the slab. The equiaxed crystals are discriminated from columnar crystals in a macroscopic solidification structure obtained by etching the cross-section of the slab. The equiaxed crystal ratio is calculated from the thickness of each crystal. The average equiaxed crystal ratio is obtained by averaging the equiaxed crystal ratios measured at the positions of 1/4, 2/4 and 3/4 in the direction of width of the slab.

In the invention, it is preferable that the cumulative rolling reduction ratio of the roughing hot rolling step should be 80% or more for suppressing the surface defects after cold rolling. If the cumulative rolling reduction ratio in the roughing hot rolling is less than the above-mentioned range, the linear band structure parallel to rolling direction caused by giant columnar grains in the cast structure of the slab remains after cold rolling, especially in the steel sheet having the chemical composition prescribed in the invention, and then surface defects may appear. More preferably, the cumulative rolling reduction ratio is 83% or more. The upper limit of the cumulative rolling reduction ratio is not restricted, since the surface defect is further suppressed by higher cumulative rolling reduction ratio in the roughing hot rolling.

Here, the cumulative rolling reduction ratio in the roughing hot rolling step is represented by the following equation using the thickness A of the slab at the inlet side of the roughing hot rolling mill and the thickness B of the bar at the outlet side of the roughing hot rolling mill:

$$(1-B/A)\times 100(\%)$$

The effect of the invention will not decrease, even by an increase in the thickness of the slab by deforming parallel to the direction of width of the slab before the roughing hot rolling. In such a case, the cumulative rolling reduction ratio of the roughing hot rolling is calculated from the thickness of the slab after deforming parallel to the direction of width of the slab.

Other conditions in the roughing hot rolling are not particularly restricted, and ordinary conditions may be acceptable.

It is preferable that the temperature of the bar after the roughing hot rolling step and before the finishing hot rolling step should be 950° C. or more for suppressing the surface defect after cold rolling. If the temperature of the bar is lower than the above-mentioned range, recrystallization during the hot rolling step is not accelerated in the steel sheet having the chemical composition prescribed in the invention, and then surface defects may appear as in the case when the cumulative rolling reduction ratio is less than the above-mentioned range. The temperature of the bar after the roughing hot rolling step and before the finishing hot rolling step is more preferably 970° C. or more. The upper limit of the temperature of the bar is not particularly restricted.

As the method for adjusting the temperature of the bar at 950° C. or more, a method for heating the slab at a high temperature and a method for heating the bar after the roughing hot rolling should be acceptable.

(2) Finishing Hot Rolling Step

The bar is subjected to the finishing hot rolling in the finishing hot rolling step of the invention.

Each condition of the finishing hot rolling is not particularly restricted, and ordinary conditions such as a finishing temperature from 700 to 950° C. and coiling temperature of 750° C. or less may be acceptable.

2. Cold Rolling Step

In the cold rolling step of the invention, the hot-rolled band obtained in the hot rolling step is subjected to one time of cold rolling or at least two times of cold rolling with intermediate annealing. The hot-rolled band is cold-rolled to a predetermined thickness in this step. The hot-rolled band may be cold-rolled to the predetermined thickness by one time of cold rolling or by at least two times of cold rolling with intermediate annealing.

It is preferable that a thickness of the cold-rolled steel sheet should be from 0.15 mm or more to 0.80 mm or less and a tensile strength of the as-cold-rolled steel sheet should be 850 MPa or more in the invention.

If the thickness is less than the above-described range, the sheet may be broken during cold rolling due to the heavy cold rolling reduction. Moreover, productivity in soaking treatment step may become poor, and furthermore the space factor of the core and interlocking strength of the laminated sheets may decrease. On the other hand, if the thickness exceeds the above-mentioned range, motor efficiency may decrease due to the increase in eddy current loss. In addition, the tensile strength of the steel sheet before soaking treatment step, namely of the as-cold-rolled steel sheet, may decrease due to a decrease in the amount of dislocations introduced during cold rolling, and therefore mechanical characteristics of the product may deteriorate. The more preferable thickness is from 0.20 mm or more to 0.70 ram or less from the above-mentioned point of view.

The strengthening mechanism of this invention is to suppress the annihilation of dislocations introduced before the soaking treatment step. Accordingly, a sufficient strength is not ensured when the amount of dislocation introduced before the soaking treatment step is small. The amount of dislocations introduced before the soaking treatment step may be estimated from the tensile strength of the steel sheet before the soaking treatment step, namely of the as-cold-rolled steel sheet, as described above. When the steel contains proper amounts of Nb, Zr, Ti and V, the annihilation of dislocations during the soaking treatment step is suppressed. When the as-cold-rolled steel sheet has the tensile strength within a predetermined range, it implies that the sufficient amount of dislocations would be introduced before the soaking treatment steps. Therefore, a sufficient amount of dislocations may remain after the soaking treatment step in the steel sheet containing proper amounts of Nb, Zr, Ti and V and having the predetermined tensile strength. Accordingly, high strength may be ensured after the soaking treatment step. Therefore, the tensile strength of the cold-rolled steel sheet is preferably 850 MPa or more, more preferably 900 MPa or more, as a value measured by taking the rolling direction as a longitudinal direction.

The tensile strength of the cold-rolled steel sheet may be measured by using a tensile test specimen parallel to the rolling direction.

In this step, the effect of the invention may be obtained, by appropriately selecting the thickness according to a desired core loss level, and by applying cold rolling so that the tensile strength maybe sufficiently ensured before the soaking treatment step, namely so that a sufficient amount of dislocations may be introduced before the soaking treatment step.

When the steel sheet is slightly deformed for leveling and flattening of the steel sheet before the soaking treatment step, namely the steel sheet is applied to a leveling and flattening step, as will be described later, the effect of the invention may be obtained when the tensile strength of the steel sheet after the leveling and flattening step satisfies the above-mentioned tensile strength.

Since the effect of the invention is obtained by introducing a sufficient amount of dislocations as described above, other conditions of cold rolling such as the temperature of the steel sheet, rolling reduction ratio and the diameter of the cold rolling mill roll are not particularly restricted, and may be appropriately selected in accordance with the chemical composition of materials and the desired thickness of the steel sheet.

The hot-rolled band obtained in the hot rolling step is usually subjected to cold rolling after removing scales formed on the surface of the steel sheet during hot rolling, namely after pickling step. When the hot-rolled band is subjected to the hot-rolled band annealing as will be described later, the hot-rolled band may be subjected to pickling step before or after the hot-rolled band annealing.

3. Soaking Treatment Step

The cold-rolled steel sheet obtained in the cold rolling step is soaked at 820° C. or less in the soaking treatment step of the invention.

The mechanism of strengthening of the invention is to suppress the annihilation of dislocations and recrystallization, which proceed during the soaking treatment step. Accordingly, the soaking temperature must be remarkably lower than that of the ordinary non-oriented electrical steel sheet when the recrystallization suppressing effect of the steel sheet is so small. The steel sheet cannot be subjected to the soaking treatment step, until the furnace temperature goes down and is stabilized at that temperature in a continuous annealing line for the ordinary non-oriented electrical steel sheet. Moreover, the ordinary non-oriented electrical steel sheet cannot be subjected to the soaking treatment step, until the furnace temperature increases to the appropriate soaking temperature for the ordinary non-oriented electrical steel sheet and the furnace temperature is stabilized at that temperature, once the furnace temperature has dropped. It may be supposed from these facts that productivity is remarkably reduced when the recrystallization suppressing effect is so small.

In the invention, recrystallization is suppressed by containing Nb, Zr, Ti and V, and the recrystallization suppressing effect becomes large when the steel sheet purposely contains Nb. Accordingly, deformed structure and recovery structure may be obtained even if the soaking temperature is high, and therefore productivity may be improved, since a special soaking temperature is not necessary. In particular, the soaking temperature should be 820° C. or less in order to obtain desired mechanical characteristics. The soaking temperature is preferably 780° C. or less, more preferably 750° C. or less in terms of mechanical characteristics. This soaking temperature is within the range for soaking temperature of the ordinary non-oriented electrical steel sheet, and therefore productivity is not impaired. Although recrystallization is further suppressed as the soaking temperature is lower, flatness of the steel sheet is not leveled and flattened. Hence, space factor of the rotor core may decrease. In addition, since core loss may be improved during the soaking treatment step, the low soaking temperature may result in an increase in core loss. Furthermore, productivity remarkably decreases when the soaking temperature is low. Accordingly, the lower limit of the soaking temperature is preferably 500° C., more preferably 600° C. or more in terms of the improvement of flatness and core loss.

Although the soaking treatment step may be applied by each method of box annealing and continuous annealing, the soaking treatment step is desirably applied in a continuous annealing line in terms of productivity. The Flatness and shape of the steel sheet may deteriorate by box annealing, since the steel sheet is subjected to annealing in a coiled state. The deterioration of flatness and shape of the steel sheet may be termed coil set. Therefore, the steel sheet is preferably subjected to a leveling and flattening step after the soaking treatment step by box annealing.

When recrystallization has been too much advanced by the soaking treatment at high temperatures and consequently mechanical characteristics deteriorate, the strength may be ensured by machining such as deforming and rolling after the soaking treatment step, although the number of steps inevitably increases.

4. Hot-rolled Band Annealing Step

The hot-rolled band obtained in the hot rolling step may be subjected to a hot-rolled band annealing in the hot-rolled band annealing step of the invention. This hot-rolled band annealing step is preformed between the hot rolling step and cold rolling step.

Although the hot-rolled band annealing step is not always essential, this step enables to improve ductility of the band and therefore the breakages of the steel sheet during the cold rolling step may be suppressed. Moreover, rough defects on the surface of the product can be reduced by this step.

The hot-rolled band annealing may be applied either by box annealing or continuous annealing. Other conditions for the hot-rolled band annealing are not particularly restricted, and may be appropriately selected in accordance with the chemical composition of the hot-rolled band etc.

5. Other Steps

It is preferable in the invention that a coating step should be applied after the soaking treatment step. In this step, an insulation coating containing only organic components, only inorganic components or a composite of organic components and inorganic components is formed on the surface of the steel sheet by an ordinary method after the soaking treatment step. An insulation coating containing no chromium may be applied in terms of reducing ill effect for environment. An insulation coating that exhibits bonding ability through heating and pressurizing maybe applied in the coating step. Acrylic resins, phenol resins, epoxy resins or melamine resins may be used as coating materials for exhibiting bonding ability.

Since the non-oriented electrical steel sheet produced in the invention is the same as those described in "A. Non-oriented electrical steel sheet", descriptions thereof are omitted herein.

C. Rotor Core

Next, the rotor core of the invention will be described. The rotor core of the invention is formed by laminating the non-oriented electrical steel sheet described above. The rotor core is produced by machining the non-oriented electrical steel sheet into a predetermined shape and by laminating the sheets. While the sheet is generally machined into a predetermined shape by punching, the method is not restricted.

Since the non-oriented electrical steel sheet that forms the rotor core is excellent in magnetic characteristics and mechanical characteristics as described above, motor efficiency can be improved by applying the rotor core of the invention to the rotor of the motor, and moreover, the motor can stably operate for a long period of time without deformation and breakage. The above-mentioned effect is particularly large in the motor such as an IPM motor that tends to deform and break by concentration of the stress. By applying the rotor core to the rotor of the generator, the generator may rotate at a higher speed, and accordingly generator efficiency may be improved, since the deformation and breakage during operation at a higher speed would be suppressed.

D. Rotating Machine

Next, the rotating machine of the invention will be described. The rotating machine of the invention has the above-mentioned rotor. The rotating machine indicates the motor and generator. The motor can generate mechanical power from electric power, while the generator can generate electric power from mechanical power. The invention collectively involves the motor and generator as the rotating machine. Since the structure of them is the same in principle, the motor will be mainly described below.

The motor has: a stator having a stator winding; and a rotor that is located at the center of the stator and rotates by being excited owing to an electric current through the stator winding. The rotor has the above-mentioned rotor core and a permanent magnet embedded in the core. The stator is formed by winding the stator winding around the stator core with slots. The stator core may be produced by machining the non-oriented electrical steel sheet into a predetermined shape and laminating the shaped sheets, or may be produced by machining an oriented electrical steel sheet with Goss texture or doubly oriented electrical steel sheet into a predetermined shape and laminating the shaped sheets. The stator core may be a segment core formed by machining the non-oriented electrical steel sheet, oriented electrical steel sheet with Goss texture and doubly oriented electrical steel sheet into a predetermined shape, and by laminating the shaped sheets. While the steel sheet is generally machined into the predetermined shape by punching, the method is not particularly restricted. Otherwise, the stator core may be formed of a magnetic powder material.

The non-oriented electrical steel sheet used for the rotor core has been described in "A. Non-oriented electrical steel sheet". The non-oriented electrical steel sheet, oriented electrical steel sheet with Goss texture, doubly oriented electrical steel sheet and magnetic powder material used for the stator core are not particularly restricted. Although the IMP motor is described as the example, the invention may be applied to a reluctance motor in terms of suppressing of deformation and breakage due to concentration of stress. Deformation and breakage due to concentration of stress may also be suppressed in other motors so long as they have the above-mentioned rotor core.

Since the motor of the invention has the rotor core formed by laminating the non-oriented electrical steel sheet excellent in magnetic characteristics and mechanical characteristics, the motor efficiency can be improved and moreover the motor may stably operate for a long period of time. Furthermore, generation efficiency may also be improved by using the rotor core for the generator.

The invention is not restricted to the above-mentioned embodiments. The above-mentioned embodiments are only exemplary, and those having substantially the same constitution as the technical idea as set forth in claims of the invention and exerts the same functions and effects may be incorporated in the technical scope of the invention.

EXAMPLES

The invention is described in more detail referring to examples below.

Example 1

Each hot-rolled band with a thickness of 2.0 ram was obtained, by vacuum refining of the steel having each composition shown in Table 3, heating the steel at 1150° C., and hot rolling at a finishing temperature of 820° C. followed by coiling at 580° C. Some of the hot-rolled bands were subjected to a hot-rolled band annealing by box annealing for 10 hours in a hydrogen atmosphere or by continuous annealing at 1000° C. for 60 seconds, and were cold-rolled to a thickness of 0.35 mm by one time of cold rolling. Some of the hot-rolled bands were cold-rolled to an intermediate thickness after the hot-rolled band annealing, followed by intermediate annealing by box annealing at 750° C. or 800° C. for 10 hours in the hydrogen atmosphere or by continuous annealing at 1000° C. for 60 seconds, and were again cold-rolled to a thickness of 0.35 mm. Some of the hot-rolled bands were cold-rolled to a thickness of 0.35 mm by one time of cold rolling or two times of cold rolling with intermediate annealing, without applying the hot-rolled band annealing. In Examples 1-1 to 1-9 and 1-11 to 1-26, the steel sheets were subjected to the soaking treatment by continuous annealing at various temperatures for 30 seconds. In Example 1-10, the steel sheet was subjected to the soaking treatment by box annealing at 500° C. for 10 hours. The steel sheets were thus produced.

TABLE 3

| | Steel composition (% by mass) | | | | | | | | | | | | |
|---|---|---|---|---|---|---|---|---|---|---|---|---|---|
| Steel | C | Si | Mn | Al | P | S | N | Nb | Zr | Ti | V | * | Others |
| A | 0.002 | 3.8 | 0.2 | 0.7 | 0.01 | 0.002 | 0.002 | 0.05 | — | — | — | 0.0002 | |
| B | 0.002 | 2.0 | 0.2 | 3.5 | 0.02 | 0.005 | 0.002 | 0.05 | 0.01 | 0.01 | — | 0.0005 | |
| C | 0.002 | 3.1 | 0.2 | 1.1 | 0.31 | 0.001 | 0.002 | 0.05 | 0.01 | 0.01 | 0.01 | 0.0007 | |
| D | 0.09 | 0.8 | 3.5 | 0.03 | 0.01 | 0.002 | 0.002 | 0.04 | — | 0.02 | — | −0.0068 | |
| E | 0.002 | 2.0 | 0.2 | 2.0 | 0.01 | 0.002 | 0.002 | 0.001 | — | — | — | −0.0003 | |
| F | 0.002 | 2.0 | 0.2 | 2.0 | 0.01 | 0.002 | 0.002 | 0.08 | — | — | — | 0.0006 | |
| G | 0.002 | 2.0 | 0.2 | 2.0 | 0.01 | 0.002 | 0.002 | 0.15 | — | — | — | 0.0013 | |
| H | 0.018 | 2.0 | 0.2 | 2.0 | 0.01 | 0.002 | 0.002 | 0.21 | — | — | — | 0.0006 | |
| I | 0.002 | 2.0 | 0.2 | 2.0 | 0.01 | 0.002 | 0.002 | 0.15 | — | 0.1 | — | 0.0034 | |
| J | 0.002 | 2.0 | 0.2 | 2.0 | 0.01 | 0.021 | 0.002 | 0.15 | — | 0.1 | — | 0.0034 | |
| K | 0.002 | 2.0 | 0.2 | 2.0 | 0.01 | 0.005 | 0.002 | 0.11 | 0.03 | 0.06 | 0.05 | 0.0034 | |
| L | 0.002 | 3.0 | 0.2 | 1.1 | 0.01 | 0.005 | 0.002 | 0.15 | — | — | 0.08 | 0.0029 | |
| M | 0.002 | 2.0 | 0.2 | 2.0 | 0.01 | 0.005 | 0.002 | 0.35 | 0.05 | 0.05 | 0.05 | 0.0060 | |
| N | 0.002 | 2.0 | 0.06 | 0.3 | 0.01 | 0.005 | 0.002 | 0.05 | — | — | — | 0.0002 | Cu: 0.8, Ni: 1.5 |
| O | 0.002 | 2.0 | 0.06 | 0.3 | 0.01 | 0.005 | 0.002 | 0.05 | — | — | — | 0.0002 | Cr: 3, Mo: 0.5 |
| P | 0.002 | 2.0 | 0.06 | 0.3 | 0.01 | 0.005 | 0.002 | 0.05 | — | — | — | 0.0002 | Co: 0.1, W: 0.1 |
| Q | 0.002 | 2.0 | 0.06 | 0.3 | 0.01 | 0.005 | 0.002 | 0.05 | — | — | — | 0.0002 | Sb: 0.03, REM: 0.006 |
| R | 0.002 | 2.0 | 0.06 | 0.3 | 0.01 | 0.005 | 0.002 | 0.05 | — | — | — | 0.0002 | Se: 0.05, Bi: 0.05 |
| S | 0.002 | 2.0 | 0.06 | 0.3 | 0.01 | 0.005 | 0.002 | 0.05 | — | — | — | 0.0002 | Ge: 0.05, Te: 0.05 |
| T | 0.002 | 2.0 | 0.06 | 0.3 | 0.01 | 0.005 | 0.002 | 0.05 | — | — | — | 0.0002 | B: 0.0008, Sn: 0.1 |
| U | 0.002 | 2.0 | 0.06 | 0.3 | 0.01 | 0.005 | 0.002 | 0.05 | — | — | — | 0.0002 | Ca: 0.005 |
| V | 0.002 | 2.0 | 0.06 | 0.3 | 0.01 | 0.005 | 0.002 | 0.05 | — | — | — | 0.0002 | Mg: 0.005 |
| W | 0.002 | 2.0 | 0.06 | 0.3 | 0.01 | 0.005 | 0.002 | 0.04 | — | — | — | 0.0001 | ** |

The underline shows the composition is out of the range of the invention.

* the value of Nb/93 + Zr/91 + Ti/48 + V/51 − (C/12 + N/14)

** 0.02% by mass as the sum of Ta, Hf, As, Au, Be, Zn, Pb, Tc, Re, Ru, Os, Rh, Ir, Pd, Pt, Ag, Cd, Hg and Po

Comparative Example 1

The steel sheets having chemical compositions shown in Table 3 were produced as in Example 1.

(Evaluation)

In Examples 1-1 to 1-26 and Comparative Examples 1-1 to 1-8, mechanical characteristics of the steel sheet before the soaking treatment step, the recrystallized fraction, mechanical characteristics, magnetic characteristics and fatigue characteristics of the steel sheet after the soaking treatment step were evaluated.

The recrystallized fraction was calculated from an optical microscopic photograph of the vertical cross-section of the steel sheet at a magnification of 100 as the ratio of recrystallized grains to total area.

Mechanical characteristics were evaluated by a tensile test using specimens prescribed in JIS No. 5 parallel to the rolling direction. The mechanical characteristic of the steel sheet before the soaking treatment step was evaluated by the tensile strength TS, while the mechanical characteristic of the steel sheet after the soaking treatment step was evaluated by the yield point YP and tensile strength TS.

For evaluating magnetic characteristics, core loss $W_{10/400}$ (Core loss at a maximum magnetic flux density of 1.0 T and exciting frequency of 400 Hz), and magnetic induction $B_{50}$ (magnetic induction at a magnetizing force of 5000 A/m) were measured by 50 mm square single strip tester. Magnetic characteristics were measured both in the rolling and transverse directions, and average values thereof were used for the evaluation.

Specimens for the fatigue test were obtained by punching. A pulsating electromagnetic resonance fatigue test at a frequency of 60 Hz was performed for the as-punched specimens. The specimen without fatigue fracture under a stress condition of a mean stress of 300 MPa, stress amplitude of 180 MPa was determined to be good in consideration of safety factor on the stress condition of the traction motor. The fatigue test was performed to $10^7$ cycles, and the fatigue characteristic was evaluated by the occurrence of fracture at this number of cycles. In Table 4, the specimen without fatigue fracture was denoted as "o", while the specimen with fatigue fracture was denoted as "x".

Table 4 shows the conditions of the hot-rolled band annealing, cold rolling and soaking treatment and evaluation results of the steel sheets in Examples 1-1 to 1-26 and Comparative Examples 1-1 to 1-8.

TABLE 4

| | Steel | Hot-rolled band annealing condition | Intermediate thickness (mm) | Intermediate annealing condition | TS before soaking treatment (MPa) | Soaking temperature (° C.) |
|---|---|---|---|---|---|---|
| Example 1-1 | F | — | — | — | 1098 | 650 |
| Example 1-2 | | 800° C. × 10 h | — | — | 1089 | 730 |
| Example 1-3 | | 1000° C. × 60 s | — | — | 1087 | 730 |
| Example 1-4 | | 750° C. × 10 h | 1.0 | 750° C. × 10 h | 1029 | 700 |
| Example 1-5 | | 1000° C. × 60 s | 1.0 | 800° C. × 10 h | 1031 | 700 |
| Example 1-6 | | 750° C. × 10 h | 1.0 | 1000° C. × 60 s | 1025 | 730 |
| Example 1-7 | | 1000° C. × 60 s | 1.0 | 1000° C. × 60 s | 1028 | 730 |
| Example 1-8 | | — | 0.8 | 750° C. × 10 h | 991 | 720 |
| Example 1-9 | | — | 1.2 | 1000° C. × 60 s | 1055 | 730 |
| Example 1-10 | | 800° C. × 10 h | — | — | 1092 | 500 |
| Example 1-11 | G | 800° C. × 10 h | — | — | 1093 | 720 |
| Example 1-12 | H | 800° C. × 10 h | — | — | 1087 | 720 |
| Example 1-13 | I | 800° C. × 10 h | — | — | 1083 | 790 |
| Example 1-14 | J | 800° C. × 10 h | — | — | 1091 | 790 |
| Example 1-15 | K | 800° C. × 10 h | — | — | 1092 | 730 |
| Example 1-16 | L | 800° C. × 10 h | — | — | 1089 | 800 |
| Example 1-17 | N | 750° C. × 10 h | — | — | 981 | 720 |
| Example 1-18 | O | 750° C. × 10 h | — | — | 979 | 720 |
| Example 1-19 | P | 750° C. × 10 h | — | — | 978 | 720 |
| Example 1-20 | Q | 750° C. × 10 h | — | — | 982 | 720 |
| Example 1-21 | R | 750° C. × 10 h | — | — | 985 | 720 |
| Example 1-22 | S | 750° C. × 10 h | — | — | 984 | 720 |
| Example 1-23 | T | 750° C. × 10 h | — | — | 976 | 720 |
| Example 1-24 | U | 750° C. × 10 h | — | — | 981 | 720 |
| Example 1-25 | V | 750° C. × 10 h | — | — | 982 | 720 |
| Example 1-26 | W | 750° C. × 10 h | — | — | 972 | 720 |
| Comparative example 1-1 | A | 800° C. × 10 h | — | — | Occurrence of breakages during cold rolling | |
| Comparative example 1-2 | B | 750° C. × 10 h | — | — | 1097 | 600 |
| Comparative example 1-3 | C | 800° C. × 10 h | — | — | Occurrence of breakages during cold-rolling | |
| Comparative example 1-4 | D | 800° C. × 10 h | 1.0 | 800° C. × 10 h | 1029 | 850 |
| Comparative example 1-5 | E | 800° C. × 10 h | — | — | 1093 | 750 |
| Comparative example 1-6 | F | 750° C. × 10 h | 0.5 | 1000° C. × 60 s | 820 | 700 |
| Comparative example 1-7 | F | 800° C. × 10 h | — | — | 1092 | 950 |
| Comparative example 1-8 | M | 800° C. × 10 h | — | — | Occurrence of breakages during cold rolling | |

| | Recrystallized fraction (%) | YP (MPa) | TS (MPa) | $B_{50}$ (T) | $W_{10/400}$ (W/kg) | Fatigue test |
|---|---|---|---|---|---|---|
| Example 1-1 | 0 | 682 | 796 | 1.63 | 37 | ○ |
| Example 1-2 | 10 | 643 | 750 | 1.64 | 34 | ○ |
| Example 1-3 | 0 | 655 | 764 | 1.63 | 36 | ○ |
| Example 1-4 | 0 | 671 | 783 | 1.62 | 35 | ○ |
| Example 1-5 | 0 | 676 | 789 | 1.63 | 36 | ○ |
| Example 1-6 | 0 | 666 | 777 | 1.63 | 32 | ○ |
| Example 1-7 | 0 | 660 | 770 | 1.63 | 36 | ○ |
| Example 1-8 | 5 | 640 | 730 | 1.63 | 35 | ○ |
| Example 1-9 | 0 | 655 | 764 | 1.62 | 35 | ○ |
| Example 1-10 | 0 | 690 | 798 | 1.62 | 36 | ○ |
| Example 1-11 | 0 | 672 | 784 | 1.63 | 35 | ○ |
| Example 1-12 | 5 | 653 | 762 | 1.63 | 35 | ○ |
| Example 1-13 | 40 | 605 | 718 | 1.63 | 31 | ○ |

TABLE 4-continued

| | | | | | | |
|---|---|---|---|---|---|---|
| Example 1-14 | 40 | 604 | 715 | 1.63 | 32 | ○ |
| Example 1-15 | 5 | 662 | 775 | 1.64 | 33 | ○ |
| Example 1-16 | 70 | 520 | 680 | 1.64 | 29 | ○ |
| Example 1-17 | 0 | 604 | 731 | 1.64 | 37 | ○ |
| Example 1-18 | 0 | 596 | 723 | 1.64 | 36 | ○ |
| Example 1-19 | 0 | 598 | 725 | 1.64 | 37 | ○ |
| Example 1-20 | 0 | 601 | 724 | 1.64 | 37 | ○ |
| Example 1-21 | 0 | 597 | 735 | 1.64 | 37 | ○ |
| Example 1-22 | 0 | 595 | 721 | 1.64 | 37 | ○ |
| Example 1-23 | 0 | 594 | 725 | 1.64 | 37 | ○ |
| Example 1-24 | 0 | 608 | 728 | 1.64 | 37 | ○ |
| Example 1-25 | 0 | 611 | 732 | 1.64 | 37 | ○ |
| Example 1-26 | 0 | 611 | 732 | 1.64 | 37 | ○ |
| Comparative example 1-1 | | Occurrence of breakages during cold rolling | | | | |
| Comparative example 1-2 | 0 | 695 | 780 | 1.51 | 42 | ○ |
| Comparative example 1-3 | | Occurrence of breakages during cold-rolling | | | | |
| Comparative example 1-4 | M structure* | 580 | 952 | 1.49 | 160 | ○ |
| Comparative example 1-5 | 100 | 347 | 460 | 1.66 | 25 | x |
| Comparative example 1-6 | 95 | 350 | 470 | 1.66 | 29 | x |
| Comparative example 1-7 | 100 | 380 | 470 | 1.65 | 28 | x |
| Comparative example 1-8 | | Occurrence of breakages during cold rolling | | | | |

The underline shows the condition is out of the range of the invention.

*The recrystallized fraction could not be measured, because the structure showed martensite.

The steel sheet of Comparative Example 1-1 was broken during cold rolling due to high amount of Si. The magnetic induction was low in the steel sheet of Comparative Example 1-2 due to high amount of Al. The steel sheet of Comparative Example 1-3 was broken during cold rolling due to high amount of P. Core loss remarkably increased and also the magnetic induction was low in the steel sheet of Comparative Example 1-4, since the amounts of C and Mn were high and the structure showed martensite. Since the amounts of Nb, Zr, Ti and V were out of the range of the invention, recrystallization was not suppressed and thus the yield point and tensile strength were poor due to a high recrystallized fraction in the steel sheet of Comparative Example 1-5. The yield point and tensile strength were poor in the steel sheet of Comparative Example 1-6, since the amount of dislocations introduced by cold rolling was insufficient. The yield point and tensile strength were poor in the steel sheet of Comparative Example 1-7, since the recrystallized fraction was high. The steel sheet of Comparative Example 1-8 was broken during cold rolling, since the amounts of Nb, Zr, Ti and V exceed the upper limit of the invention.

On the contrary, both magnetic characteristics and mechanical characteristics were excellent in the steel sheets of Examples 1-1 to 1-26 that satisfied the conditions prescribed in the invention irrespective of the method of the hot-rolled band annealing and the number of steps for cold rolling, and no fatigue fracture occurred even under the above-mentioned stress condition.

It has been found that the steel sheet has excellent magnetic characteristics and mechanical characteristics due to a large recrystallization suppressing effect even under a condition in which the soaking temperature is relatively high. It has been also found from the comparison between Examples 1-13 and 1-14 that the amount of S do not affect on mechanical characteristics.

Example 2

Each continuous cast slab having the chemical composition shown in Table 5 was heated under the conditions shown in Table 6, and was applied a roughing hot rolling, and then they were applied a finishing hot rolling at a finishing temperature of 850° C. and coiling temperature of 550° C. As a result, each hot-rolled band with a thickness of 2.0 mm was obtained. These hot-rolled bands were subjected to the hot-rolled band annealing by box annealing at 750° C. for 10 hours, and were cold-rolled to a thickness of 0.35 mm by one time of cold rolling. Then, the steel sheets were subjected to a soaking treatment by continuous annealing at 700° C., and an insulation coating with an average thickness of 0.4 μm was coated on the surface of each of the steel sheets.

Mechanical characteristics, magnetic characteristics and space factor of the steel sheet were evaluated.

As mechanical characteristics, the yield point YP and tensile strength TS was measured by a tensile test using a specimen prescribed in JIS No. 5 parallel to the rolling direction.

For evaluating magnetic characteristics and space factor, specimens were sampled according to JIS C2550. As magnetic characteristics, core loss $W_{10/400}$ (Core loss at a maximum magnetic flux density of 1.0 T and exciting frequency of 400 Hz), and magnetic induction $B_{50}$ (magnetic induction at a magnetizing force of 5000 A/m) were measured. A space factor of 98% or more was evaluated as "A", a space factor of from 95% or more to less than 98% was evaluated as "B", and a space factor of less than 95% was evaluated as "C", and "A" and "B" were determined to be acceptable levels for the rotor core.

The average equiaxed crystal ratio in the slab was measured as described above.

The results of evaluation are shown in Table 6.

TABLE 5

| Steel | Steel composition (% by mass) | | | | | | | | | | | |
|---|---|---|---|---|---|---|---|---|---|---|---|---|
| | C | Si | Mn | Al | P | S | N | Nb | Zr | Ti | V | * |
| a | 0.002 | 2.0 | 0.2 | 2.0 | 0.01 | 0.002 | 0.002 | 0.001 | — | — | — | −0.0003 |
| b | 0.002 | 2.0 | 0.2 | 2.0 | 0.01 | 0.002 | 0.002 | 0.08 | — | — | — | 0.0006 |
| c | 0.002 | 2.0 | 0.2 | 2.0 | 0.01 | 0.002 | 0.002 | 0.15 | — | 0.1 | — | 0.0034 |
| d | 0.002 | 2.0 | 0.2 | 2.0 | 0.01 | 0.021 | 0.002 | 0.15 | — | 0.1 | — | 0.0034 |
| e | 0.002 | 2.0 | 0.2 | 2.0 | 0.01 | 0.005 | 0.002 | 0.11 | 0.03 | 0.06 | 0.05 | 0.0034 |

The underline shows the composition is out of the range of the invention.
* the value of Nb/93 + Zr/91 + Ti/48 + V/51 − (C/12 + N/14)

TABLE 6

| No. | Steel | Average equixed crystal ratio (%) | Heating temperature (° C.) | Cumulative rolling reduction ratio in roughing rolling (%) | Temperature at outlet side of roughing rolling (° C.) | YP (MPa) | TS (MPa) | $B_{50}$ (T) | $W_{10/400}$ (W/kg) | Evaluation of space factor |
|---|---|---|---|---|---|---|---|---|---|---|
| 2-1 | a | 10 | 1150 | 86 | 980 | 347 | 460 | 1.66 | 25 | A |
| 2-2 | b | <10 | 1150 | 86 | 980 | 655 | 764 | 1.64 | 34 | B |
| 2-3 | c | <10 | 1150 | 83 | 1000 | 664 | 771 | 1.64 | 36 | B |
| 2-4 | d | 15 | 1150 | 86 | 1000 | 658 | 768 | 1.64 | 35 | B |
| 2-5 | e | 10 | 1150 | 83 | 980 | 649 | 759 | 1.64 | 36 | B |
| 2-6 | a | 10 | 1150 | 77 | 980 | 344 | 358 | 1.66 | 26 | A |
| 2-7 | b | <10 | 1150 | 77 | 980 | 661 | 757 | 1.64 | 34 | C |
| 2-8 | c | <10 | 1050 | 83 | 920 | 658 | 751 | 1.64 | 34 | C |
| 2-9 | d | 15 | 1150 | 86 | 930 | 649 | 768 | 1.64 | 35 | C |
| 2-10 | e | 10 | 1150 | 77 | 980 | 642 | 771 | 1.64 | 34 | C |
| 2-11 | a | 30 | 1150 | 77 | 980 | 352 | 461 | 1.66 | 25 | A |
| 2-12 | b | 30 | 1150 | 77 | 980 | 647 | 771 | 1.66 | 35 | C |
| 2-13 | c | 40 | 1050 | 83 | 920 | 642 | 767 | 1.66 | 35 | C |
| 2-14 | d | 40 | 1150 | 86 | 930 | 653 | 749 | 1.66 | 34 | C |
| 2-15 | e | 40 | 1150 | 83 | 930 | 634 | 758 | 1.66 | 36 | C |
| 2-16 | a | 30 | 1150 | 86 | 980 | 357 | 457 | 1.66 | 24 | A |
| 2-17 | b | 30 | 1150 | 86 | 980 | 643 | 766 | 1.66 | 35 | A |
| 2-18 | c | 40 | 1200 | 83 | 1000 | 658 | 755 | 1.66 | 36 | A |
| 2-19 | d | 40 | 1200 | 86 | 1000 | 651 | 761 | 1.66 | 35 | A |
| 2-20 | e | 40 | 1200 | 83 | 1010 | 664 | 758 | 1.66 | 35 | A |

The underline shows the condition is out of the range of the invention.

Since the amounts of Nb, Zr, Ti and V were out of the range of the invention, the steel sheets Nos. 2-1, 2-6, 2-11 and 2-16 using steel "a" were poor in mechanical characteristics and thus the strength necessary for the rotor was not ensured. Although mechanical characteristics of the steel sheet Nos. 2-2 to 2-5, 2-7 to 2-10, 2-12 to 2-15 and 2-17 to 2-20 using steels "b", "c", "d" and "e" with chemical compositions within the range of the invention were excellent, the space factor decreased when the slab heating conditions and roughing hot rolling conditions were out of preferable conditions (Nos. 2-7 to 2-10, 2-12 to 2-15). On the other hand, the steel sheets Nos. 2-2 to 2-5 and 2-17 to 2-20 having chemical compositions in the range of the invention and produced within preferable production conditions were excellent in magnetic characteristics, mechanical characteristics and space factor.

Example 3

Each hot-rolled band with a thickness of 2.0 mm was obtained, by heating each continuous cast slab having the chemical composition shown in Table 7 at 1150° C., subjecting to the roughing hot rolling with a cumulative rolling reduction ratio of 86% so that the temperature at the outlet of the roughing hot rolling mill was 980° C., and subjecting to the finishing hot rolling at a finishing temperature of 820° C. and coiling temperature of 580° C. These hot-rolled bands were subjected to the hot-rolled band annealing by box annealing at 750° C. or 800° C. for 10 hours or by continuous annealing at 1000° C. for 60 seconds, and were cold-rolled to a thickness of 0.35 mm by one time of cold rolling. The steel sheets were subjected to a soaking treatment step by continuous annealing at various temperatures shown in Table 8, and then an insulation coating with an average thickness of 0.4 Jura was coated on the surface of each of the steel sheets.

Magnetic characteristics, mechanical characteristics and space factor of the steel sheet were evaluated. The average equiaxed crystal ratio in all the steel sheets was in the range from 25 to 30%.

As mechanical characteristics, the yield point YP and tensile strength TS was evaluated by a tensile test using a specimen prescribed in JIS No. 5 parallel to the rolling direction as the longitudinal direction.

Magnetic characteristics and space factor were evaluated with the specimens sampled according to JIS C2550. As magnetic characteristics, core loss $W_{10/400}$ (Core loss at a maximum magnetic flux density of 1.0 T and a exciting frequency of 400 Hz) and magnetic induction $B_{50}$ (magnetic induction at a magnetizing force of 5000 A/m) were measured. A space factor of 98% or more was evaluated as "A", a space factor of from 95% or more to less than 98% was evaluated as "B", and a space factor of less than 95% was evaluated as "C", and "A" and "B" were determined to be acceptable levels for the rotor core.

The results of evaluation are shown in Table 8.

TABLE 7

| Steel | Steel composition (% by mass) | | | | | | | | | | | | |
|---|---|---|---|---|---|---|---|---|---|---|---|---|---|
| | C | Si | Mn | Al | P | S | N | Nb | Zr | Ti | V | * | Others |
| f | 0.002 | 3.8 | 0.2 | 0.7 | 0.01 | 0.002 | 0.002 | 0.05 | — | — | — | 0.0002 | |
| g | 0.002 | 2.0 | 0.2 | 3.5 | 0.02 | 0.005 | 0.002 | 0.05 | 0.01 | 0.01 | — | 0.0005 | |
| h | 0.002 | 3.1 | 0.2 | 1.1 | 0.31 | 0.001 | 0.002 | 0.05 | 0.01 | 0.01 | 0.01 | 0.0007 | |
| i | 0.09 | 0.8 | 3.5 | 0.03 | 0.01 | 0.002 | 0.002 | 0.04 | — | 0.02 | — | −0.0068 | |
| j | 0.002 | 2.0 | 0.2 | 2.0 | 0.01 | 0.005 | 0.002 | 0.35 | 0.05 | 0.05 | 0.05 | 0.0060 | |
| k | 0.002 | 3.0 | 0.2 | 1.1 | 0.01 | 0.005 | 0.002 | 0.15 | — | — | 0.08 | 0.0029 | |
| l | 0.002 | 2.0 | 0.06 | 0.3 | 0.01 | 0.005 | 0.002 | 0.05 | — | — | — | 0.0002 | Cu: 0.8, Ni: 1.5 |
| m | 0.002 | 2.0 | 0.06 | 0.3 | 0.01 | 0.005 | 0.002 | 0.05 | — | — | — | 0.0002 | Cr: 3, Mo: 0.5 |
| n | 0.002 | 2.0 | 0.06 | 0.3 | 0.01 | 0.005 | 0.002 | 0.05 | — | — | — | 0.0002 | Co: 0.1, W: 0.1 |
| o | 0.002 | 2.0 | 0.06 | 0.3 | 0.01 | 0.005 | 0.002 | 0.05 | — | — | — | 0.0002 | Sb: 0.03, REM: 0.006 |
| p | 0.002 | 2.0 | 0.06 | 0.3 | 0.01 | 0.005 | 0.002 | 0.05 | — | — | — | 0.0002 | Se: 0.05, Bi: 0.05 |
| q | 0.002 | 2.0 | 0.06 | 0.3 | 0.01 | 0.005 | 0.002 | 0.05 | — | — | — | 0.0002 | Ge: 0.05, Te: 0.05 |
| r | 0.002 | 2.0 | 0.06 | 0.3 | 0.01 | 0.005 | 0.002 | 0.05 | — | — | — | 0.0002 | B: 0.0008, Sn: 0.1 |
| s | 0.002 | 2.0 | 0.06 | 0.3 | 0.01 | 0.005 | 0.002 | 0.05 | — | — | — | 0.0002 | Ca: 0.005 |
| t | 0.002 | 2.0 | 0.06 | 0.3 | 0.01 | 0.005 | 0.002 | 0.05 | — | — | — | 0.0002 | Mg: 0.005 |
| u | 0.002 | 2.0 | 0.06 | 0.3 | 0.01 | 0.005 | 0.002 | 0.05 | — | — | — | 0.0002 | ** |

The underline shows the composition is out of the range of the invention.

* the value of Nb/93 + Zr/91 + Ti/48 + V/51 − (C/12 + N/14)

** 0.02% by mass as the sum of Ta, Hf, As, Au, Be, Zn, Pb, Tc, Re, Ru, Os, Rh, Ir, Pd, Pt, Ag, Cd, Hg and Po

TABLE 8

| No. | Steel | Hot-rolled band annealing condition | Soaking temperature (° C.) | YP (MPa) | TS (MPa) | $B_{50}$ (T) | $W_{10/400}$ (W/kg) | Evaluation of space factor |
|---|---|---|---|---|---|---|---|---|
| 3-1 | k | 1000° C. × 60 s | 730 | 668 | 769 | 1.64 | 34 | A |
| 3-2 | l | 750° C. × 10 h | 720 | 604 | 731 | 1.64 | 37 | A |
| 3-3 | m | 750° C. × 10 h | 720 | 596 | 723 | 1.64 | 36 | A |
| 3-4 | n | 750° C. × 10 h | 720 | 598 | 725 | 1.64 | 37 | A |
| 3-5 | o | 1000° C. × 60 s | 750 | 601 | 724 | 1.64 | 37 | A |
| 3-6 | p | 750° C. × 10 h | 720 | 597 | 735 | 1.64 | 37 | A |
| 3-7 | q | 750° C. × 10 h | 720 | 595 | 721 | 1.64 | 37 | A |
| 3-8 | r | 750° C. × 10 h | 720 | 594 | 725 | 1.64 | 37 | A |
| 3-9 | s | 750° C. × 10 h | 720 | 608 | 728 | 1.64 | 37 | A |
| 3-10 | t | 1000° C. × 60 s | 750 | 611 | 732 | 1.64 | 37 | A |
| 3-11 | u | 750° C. × 10 h | 720 | 612 | 735 | 1.64 | 37 | A |
| 3-12 | f | 800° C. × 10 h | Occurrence of breakages during cold rolling | | | | | |
| 3-13 | g | 750° C. × 10 h | 720 | 595 | 723 | 1.51 | 42 | B |
| 3-14 | h | 800° C. × 10 h | Occurrence of breakages during cold rolling | | | | | |
| 3-15 | i | 800° C. × 10 h | 850 | 580 | 952 | 1.49 | 160 | A |
| 3-16 | j | 800° C. × 10 h | Occurrence of braekages during cold rolling | | | | | |

The underline shows the condition is out of the range of the invention

The steel sheet No. 3-12 was broken during cold rolling due to a high amount of Si. The magnetic induction of the steel sheet No. 3-13 was low due to a high amount of Al. The steel sheet No. 3-14 was broken during cold rolling due to a high amount of P. Core loss remarkably increased and magnetic induction was also low in the steel sheet No. 3-15, since the amounts of C and Mn were high and therefore the steel structure showed martensite. The steel sheet No. 3-16 was broken during cold rolling, since the amounts of Nb, Zr, Ti and V exceeded the upper limit of the invention.

On the contrary, the magnetic characteristics, mechanical characteristics and space factor were excellent in the steel sheets Nos. 3-1 to 3-11 that satisfied the chemical composition prescribed in the invention. As shown by Nos. 3-2 to 3-11, it has been found that the effect of the invention may be obtained when the steel sheet contains proper amounts of Cu, Ni, Cr, Mo, Co, W, Sn, Sb, Se, Bi, Ge, Te, B, Ca, Mg and REM. It has been also found that the effect of the invention may be obtained when the steel sheet contains proper amounts of Ta, Hf, As, Au, Be, Zn, Pb, Tc, Re, Ru, Os, Rh, Ir, Pd, Pt, Ag, Cd, Hg and Po.

Example 4

Each hot-rolled band with a thickness of 2.0 mm was obtained, by vacuum refining of the steel having each chemical composition in Table 9, heating the steel at 1150° C. and hot rolling at a finishing temperature of 820° C. followed by coiling at 580° C. Some of the hot-rolled bands were subjected to a hot-rolled band annealing by box annealing for 10 hours in a hydrogen atmosphere or by continuous annealing at 1000° C. for 60 seconds, and were cold-rolled to a various thickness by one time of cold rolling. Some of the hot-rolled bands were cold-rolled to an intermediate thickness after the hot-rolled band annealing, followed by intermediate annealing by box annealing at 750° C. or 800° C. for 10 hours in the hydrogen atmosphere or by continuous annealing at 1000° C. for 60 seconds, and were again cold-rolled to various thicknesses. Some of the hot-rolled bands were cold-rolled to various thicknesses by one time of cold rolling or two times of cold rolling with intermediate annealing, without applying the hot-rolled band annealing. In Nos. 4-1 to 4-9 and 4-11 and 4-27, the steel sheets were subjected to the soaking treatment step by continuous annealing at various temperatures for 30 seconds. In No. 4-10, the steel sheet was subjected to the soaking treatment step by box annealing at 500° C. for 10 hours.

The hot-rolled band annealing condition, cold rolling condition and soaking condition of each steel sheet are shown in Table 10.

TABLE 9

| Steel | Steel composition (% by mass) | | | | | | | | | | | | |
|---|---|---|---|---|---|---|---|---|---|---|---|---|---|
| | C | Si | Mn | Al | P | S | N | Nb | Zr | Ti | V | * | Others |
| A | 0.002 | 3.8 | 0.2 | 0.7 | 0.01 | 0.002 | 0.002 | 0.05 | — | — | — | 0.0002 | |
| B | 0.002 | 2.0 | 0.2 | 3.5 | 0.02 | 0.005 | 0.002 | 0.05 | 0.01 | 0.01 | — | 0.0005 | |
| C | 0.002 | 3.1 | 0.2 | 1.1 | 0.31 | 0.001 | 0.002 | 0.05 | 0.01 | 0.01 | 0.01 | 0.0007 | |
| D | 0.09 | 0.8 | 3.5 | 0.03 | 0.01 | 0.002 | 0.002 | 0.04 | — | 0.02 | — | −0.0068 | |
| E | 0.002 | 2.0 | 0.2 | 2.0 | 0.01 | 0.002 | 0.002 | 0.001 | — | — | — | −0.0003 | |
| F | 0.002 | 2.0 | 0.2 | 2.0 | 0.01 | 0.002 | 0.002 | 0.08 | — | — | — | 0.0006 | |
| G | 0.002 | 2.0 | 0.2 | 2.0 | 0.01 | 0.002 | 0.002 | 0.15 | — | — | — | 0.0013 | |
| H | 0.018 | 2.0 | 0.2 | 2.0 | 0.01 | 0.002 | 0.002 | 0.21 | — | — | — | 0.0006 | |
| I | 0.002 | 2.0 | 0.2 | 2.0 | 0.01 | 0.002 | 0.002 | 0.15 | — | 0.1 | — | 0.0034 | |
| J | 0.002 | 2.0 | 0.2 | 2.0 | 0.01 | 0.021 | 0.002 | 0.15 | — | 0.1 | — | 0.0034 | |
| K | 0.002 | 2.0 | 0.2 | 2.0 | 0.01 | 0.005 | 0.002 | 0.11 | 0.03 | 0.06 | 0.05 | 0.0034 | |
| L | 0.002 | 3.0 | 0.2 | 1.1 | 0.01 | 0.005 | 0.002 | 0.15 | — | — | 0.08 | 0.0029 | |
| M | 0.002 | 2.0 | 0.2 | 2.0 | 0.01 | 0.005 | 0.002 | 0.35 | 0.05 | 0.05 | 0.05 | 0.0060 | |
| N | 0.002 | 2.0 | 0.06 | 0.3 | 0.01 | 0.005 | 0.002 | 0.05 | — | — | — | 0.0002 | Cu: 0.8, Ni: 1.5 |
| O | 0.002 | 2.0 | 0.06 | 0.3 | 0.01 | 0.005 | 0.002 | 0.05 | — | — | — | 0.0002 | Cr: 3, Mo: 0.5 |
| P | 0.002 | 2.0 | 0.06 | 0.3 | 0.01 | 0.005 | 0.002 | 0.05 | — | — | — | 0.0002 | Co: 0.1, W: 0.1 |
| Q | 0.002 | 2.0 | 0.06 | 0.3 | 0.01 | 0.005 | 0.002 | 0.05 | — | — | — | 0.0002 | Sb: 0.03, REM: 0.006 |
| R | 0.002 | 2.0 | 0.06 | 0.3 | 0.01 | 0.005 | 0.002 | 0.05 | — | — | — | 0.0002 | Se: 0.05, Bi: 0.05 |
| S | 0.002 | 2.0 | 0.06 | 0.3 | 0.01 | 0.005 | 0.002 | 0.05 | — | — | — | 0.0002 | Ge: 0.05, Te: 0.05 |
| T | 0.002 | 2.0 | 0.06 | 0.3 | 0.01 | 0.005 | 0.002 | 0.05 | — | — | — | 0.0002 | B: 0.0008, Sn: 0.1 |
| U | 0.002 | 2.0 | 0.06 | 0.3 | 0.01 | 0.005 | 0.002 | 0.05 | — | — | — | 0.0002 | Ca: 0.005 |
| V | 0.002 | 2.0 | 0.06 | 0.3 | 0.01 | 0.005 | 0.002 | 0.05 | — | — | — | 0.0002 | Mg: 0.005 |
| W | 0.002 | 2.0 | 0.06 | 0.3 | 0.01 | 0.005 | 0.002 | 0.04 | — | — | — | 0.0001 | ** |
| X | 0.002 | 2.0 | 0.2 | 2.0 | 0.01 | 0.002 | 0.002 | 0.001 | — | 0.15 | — | 0.0028 | |

The underline shows the composition is out of the range of the invention.

* the value of Nb/93 + Zr/91 + Ti/48 + V/51 − (C/12 + N/14)

** 0.02% by mass as the sum of Ta, Hf, As, Au, Be, Zn, Pb, Tc, Re, Ru, Os, Rh, Ir, Pd, Pt, Ag, Cd, Hg and Po

Comparative Example 2

Steel sheets were produced by the same method as in Example 4 using each of steel having the chemical composition shown in Table 9.

(Evaluation)

Mechanical characteristics before the soaking treatment step, and mechanical characteristics and magnetic characteristics after the soaking treatment step were evaluated for the steel sheets Nos. 4-1 to 4-27 and 5-1 to 5-11.

Mechanical characteristics were evaluated by the tensile test using a specimen prescribed in JIS No. 5 parallel to the rolling direction. The mechanical characteristics before the soaking treatment step were evaluated by tensile strength TS, and the mechanical characteristics after the soaking treatment step were evaluated by the yield point YP and tensile strength TS.

For evaluating magnetic characteristics, core loss $W_{10/400}$ (Core loss at a maximum magnetic flux density of 1.0 T and exciting frequency of 400 Hz), and magnetic induction $B_{50}$ (magnetic induction at a magnetizing force of 5000 A/m) were measured by a 50 mm square single strip tester. Magnetic characteristics were measured both in rolling and transverse direction, and an average of these values was used.

Table 10 shows the evaluation results.

TABLE 10

| No. | Steel | Hot-rolled band annealing condition | Intermediate thickness (mm) | Intermediate annealing condition | Thickness of cold-rolled sheet (mm) | TS before soaking treatment (MPa) |
|---|---|---|---|---|---|---|
| 4-1 | F | — | — | — | 0.60 | 1019 |
| 4-2 | | 800° C. × 10 h | — | — | 0.25 | 1100 |
| 4-3 | | 1000° C. × 60 s | — | — | 0.35 | 1087 |
| 4-4 | | 750° C. × 10 h | 1.0 | 750° C. × 10 h | 0.50 | 1021 |
| 4-5 | | 1000° C. × 60 s | 1.0 | 800° C. × 10 h | 0.35 | 1031 |
| 4-6 | | 750° C. × 10 h | 1.0 | 1000° C. × 60 s | 0.35 | 1025 |
| 4-7 | | 1000° C. × 60 s | 1.0 | 1000° C. × 60 s | 0.35 | 1028 |
| 4-8 | | — | 0.8 | 750° C. × 10 h | 0.35 | 991 |
| 4-9 | | — | 1.2 | 1000° C. × 60 s | 0.20 | 1055 |
| 4-10 | | 800° C. × 10 h | — | — | 0.35 | 1092 |
| 4-11 | G | 800° C. × 10 h | — | — | 0.35 | 1093 |
| 4-12 | H | 800° C. × 10 h | — | — | 0.35 | 1087 |
| 4-13 | I | 800° C. × 10 h | — | — | 0.35 | 1083 |
| 4-14 | J | 800° C. × 10 h | — | — | 0.35 | 1091 |
| 4-15 | K | 800° C. × 10 h | — | — | 0.35 | 1092 |
| 4-16 | L | 800° C. × 10 h | — | — | 0.35 | 1089 |
| 4-17 | N | 750° C. × 10 h | — | — | 0.35 | 981 |
| 4-18 | O | 750° C. × 10 h | — | — | 0.35 | 979 |
| 4-19 | P | 750° C. × 10 h | — | — | 0.35 | 978 |
| 4-20 | Q | 750° C. × 10 h | — | — | 0.50 | 932 |
| 4-21 | R | 750° C. × 10 h | — | — | 0.35 | 985 |
| 4-22 | S | 750° C. × 10 h | — | — | 0.35 | 984 |
| 4-23 | T | 750° C. × 10 h | — | — | 0.35 | 976 |

TABLE 10-continued

| | | | | | | |
|---|---|---|---|---|---|---|
| 4-24 | U | 750° C. × 10 h | — | — | 0.35 | 981 |
| 4-25 | V | 750° C. × 10 h | — | — | 0.35 | 982 |
| 4-26 | W | 750° C. × 10 h | — | — | 0.35 | 972 |
| 4-27 | X | 800° C. × 10 h | — | — | 0.35 | 1088 |
| 5-1 | A | 800° C. × 10 h | — | — | Occurrence of breakages during cold rolling | |
| 5-2 | B | 750° C. × 10 h | — | — | 0.35 | 1097 |
| 5-3 | C | 800° C. × 10 h | — | — | Occurrence of breakages during cold rolling | |
| 5-4 | D | 800° C. × 10 h | 1.0 | 800° C. × 10 h | 0.35 | 1029 |
| 5-5 | E | 800° C. × 10 h | — | — | 0.35 | 1093 |
| 5-6 | F | 750° C. × 10 h | 0.5 | 1000° C. × 60 s | 0.35 | 820 |
| 5-7 | F | 800° C. × 10 h | — | — | 0.35 | 1092 |
| 5-8 | F | 750° C. × 10 h | 0.5 | 1000° C. × 60 s | 0.35 | 820 |
| 5-9 | M | 800° C. × 10 h | — | — | Occurrence of breakages during cold rolling | |
| 5-10 | F | 750° C. × 10 h | — | — | 0.90 | 884 |
| 5-11 | F | 750° C. × 10 h | — | — | 0.10 | Occurrence of edge crack during cold rolling |

| No. | Soaking temperature (° C.) | Recrystallized fraction (%) | YP (MPa) | TS (MPa) | $B_{50}$ (T) | $W_{10/400}$ (W/kg) |
|---|---|---|---|---|---|---|
| 4-1 | 650 | 0 | 625 | 730 | 1.63 | 38 |
| 4-2 | 730 | 10 | 660 | 788 | 1.64 | 32 |
| 4-3 | 730 | 0 | 655 | 764 | 1.63 | 36 |
| 4-4 | 700 | 0 | 648 | 731 | 1.62 | 37 |
| 4-5 | 700 | 0 | 676 | 789 | 1.63 | 36 |
| 4-6 | 730 | 0 | 666 | 777 | 1.63 | 32 |
| 4-7 | 730 | 0 | 660 | 770 | 1.63 | 36 |
| 4-8 | 720 | 5 | 640 | 730 | 1.63 | 35 |
| 4-9 | 730 | 0 | 655 | 764 | 1.62 | 29 |
| 4-10 | 500 | 0 | 690 | 798 | 1.62 | 36 |
| 4-11 | 720 | 0 | 672 | 784 | 1.63 | 35 |
| 4-12 | 720 | 5 | 653 | 762 | 1.63 | 35 |
| 4-13 | 790 | 40 | 605 | 718 | 1.63 | 31 |
| 4-14 | 790 | 40 | 604 | 715 | 1.63 | 32 |
| 4-15 | 730 | 5 | 662 | 775 | 1.64 | 33 |
| 4-16 | 800 | 70 | 520 | 680 | 1.64 | 29 |
| 4-17 | 720 | 0 | 604 | 731 | 1.64 | 37 |
| 4-18 | 720 | 0 | 596 | 723 | 1.64 | 36 |
| 4-19 | 720 | 0 | 598 | 725 | 1.64 | 37 |
| 4-20 | 720 | 0 | 548 | 695 | 1.64 | 38 |
| 4-21 | 720 | 0 | 597 | 735 | 1.64 | 37 |
| 4-22 | 720 | 0 | 595 | 721 | 1.64 | 37 |
| 4-23 | 720 | 0 | 594 | 725 | 1.64 | 37 |
| 4-24 | 720 | 0 | 608 | 728 | 1.64 | 37 |
| 4-25 | 720 | 0 | 611 | 732 | 1.64 | 37 |
| 4-26 | 810 | 0 | 518 | 650 | 1.64 | 30 |
| 4-27 | 730 | 15 | 618 | 721 | 1.63 | 34 |
| 5-1 | | Occurrence of breakages during cold rolling | | | | |
| 5-2 | 600 | 0 | 695 | 780 | 1.51 | 42 |
| 5-3 | | Occurrence of breakages during cold rolling | | | | |
| 5-4 | 850 | M structure* | 580 | 952 | 1.49 | 160 |
| 5-5 | 750 | 100 | 347 | 460 | 1.66 | 25 |
| 5-6 | 700 | 95 | 350 | 470 | 1.66 | 29 |
| 5-7 | 950 | 100 | 380 | 470 | 1.65 | 28 |
| 5-8 | 950 | 100 | 342 | 448 | 1.66 | 28 |
| 5-9 | | Occurrence of breakages during cold rolling | | | | |
| 5-10 | 750 | 10 | 612 | 699 | 1.66 | 46 |
| 5-11 | | Occurrence of edge crack during cold rolling | | | | |

The underline show the condition is out of the range of the invention.

*The recrystallized fraction could not be measured, because the structure showed martensite.

The steel sheet No. 5-1 was broken during cold rolling due to high amount of Si. The magnetic induction of the steel sheet No. 5-2 was low due to high amount of Al. The steel sheet No. 5-3 was broken during cold rolling due to high amount of P. Core loss remarkably increased and magnetic induction was also low in the steel sheet No. 5-4, since the amounts of C and Mn were high and the stricture showed martensite. Since the amounts of Nb, Zr, Ti and V were out of the range of the invention, annihilation of dislocations during the soaking treatment step was not suppressed in the steel sheet No. 5-5, hence both the yield point and tensile strength were poor even when the amount of dislocations introduced before the soaking treatment step was sufficient. Both the yield point and tensile strength were poor in the steel sheet No. 5-6, since the amount of dislocations introduced before the soaking treatment step was insufficient. The yield point and tensile strength of the steel sheet No. 5-7 were poor, since the soaking temperature was too high. The steel sheet No. 5-8 was poor in both the yield point and tensile strength, since the amount of dislocations introduced before the soaking treatment step was insufficient and furthermore the soaking temperature was too high. The steel sheet No. 5-9 was broken during cold rolling, since the amounts of Nb, Zr, Ti and V exceeded the upper limit of the range of the invention. Core loss of the steel sheet No. 5-10 increased, since the thickness after cold rolling exceeded 0.80 mm. Since the thickness of the steel sheet was lower than 0.15 mm, edge crack occurred during cold rolling in No. 5-11 and therefore the steel sheet could not be soaked.

On the contrary, the steel sheets Nos. 4-1 to 4-27 that satisfied the conditions prescribed in the invention were excellent in both magnetic characteristics and mechanical characteristics irrespective of the hot-rolled band annealing methods and the numbers of cold rolling.

It has been found that the steel sheet has excellent magnetic characteristics and mechanical characteristics due to a large recrystallization suppressing effect even at the high soaking temperature. It has been also found from the comparison with the steel sheets Nos. 4-13 and 4-14 that the amount of S do not affect on the mechanical characteristics. As shown by Nos. 4-17 to 4-26, it has been found that the effect of the invention may be obtained when the steel sheet contains proper amounts of Cu, Ni, Cr, Mo, Co, W, Sn, Sb, Se, Bi, Ge, Te, B, Ca, Mg and REM. It has been also found that the effect of the invention may be obtained when the steel sheet contains proper amounts of Ta, Hf, As, Au, Be, Zn, Pb, Tc, Re, Ru, Os, Rh, Ir, Pd, Pt, Ag, Cd, Hg and Po.

The invention claimed is:

1. A non-oriented electrical steel sheet comprising in % by mass: 0.06% or less of C; 3.5% or less of Si; from 0.05% or more to 3.0% or less of Mn; from 0.01% or more to 2.5% or less of Al; 0.30% or less of P; 0.04% or less of S; 0.02% or less of N; at least one element selected from the group consisting of Nb, Ti, Zr and V in the range satisfying equation (1) below; as arbitrarily added elements, from 0% or more to 8.0% or less of Cu, from 0% or more to 2.0% or less of Ni, from 0% or more to 15.0% or less of Cr, from 0% or more to 4.0% or less of Mo, from 0% or more to 4.0% or less of Co, from 0% or more to 4.0% or less of W, from 0% or more to 0.5% or less of Sn, from 0% or more to 0.5% or less of Sb, from 0% or more to 0.3% or less of Se, from 0% or more to 0.2% or less of Bi, from 0% or more to 0.5% or less of Ge, from 0% or more to 0.3% or less of Te, from 0% or more to 0.01% or less of B, from 0% or more to 0.03% or less of Ca, from 0% or more to 0.02% or less of Mg and from 0% or more to 0.1% or less of REM; and a balance consisting of Fe and impurities; and having a recrystallized fraction being less than 90%;

$$0<Nb/93+Zr/91+Ti/48+V/51-(C/12+N/14)<5\times10^{-3} \quad (1)$$

(in equation (1), Nb, Zr, Ti, V, C and N represents the contents (% by mass) of respective elements).

2. The non-oriented electrical steel sheet according to claim 1 comprising, in % by mass, more than 0.02% of Nb.

3. The non-oriented electrical steel sheet according to claim 1, comprising at least one element selected from the group consisting of Cu, Ni, Cr, Mo, Co and W in % by mass described below:

from 0.01% or more to 8.0% or less of Cu;
from 0.01% or more to 2.0% or less of Ni;
from 0.01% or more to 15.0% or less of Cr;
from 0.005% or more to 4.0% or less of Mo;
from 0.01% or more to 4.0% or less of Co; and
from 0.01% or more to 4.0% or less of W.

4. The non-oriented electrical steel sheet according to claim 1, comprising at least one element selected from the group consisting of Sn, Sb, Se, Bi, Ge, Te and B in % by mass described below:

from 0.001% or more to 0.5% or less of Sn;
from 0.0005% or more to 0.5% or less of Sb;
from 0.0005% or more to 0.3% or less of Se;
from 0.0005% or more to 0.2% or less of Bi;
from 0.001% or more to 0.5% or less of Ge;
from 0.0005% or more to 0.3% or less of Te; and
from 0.0002% or more to 0.01% or less of B.

5. The non-oriented electrical steel sheet according to claim 1, comprising at least one element selected from the group consisting of Ca, Mg and REM in % by mass described below:

from 0.0001% or more to 0.03% or less of Ca;
from 0.0001% or more to 0.02% or less of Mg; and
from 0.0001% or more to 0.1% or less of REM.

6. A method for producing a non-oriented electrical steel sheet comprising the steps of:

a hot rolling step for subjecting a steel ingot or slab having a steel composition according to claim 1 to hot rolling;

a cold rolling step for subjecting a hot-rolled band obtained in the hot rolling step to one time of cold rolling or at least two times of cold rolling with intervention of intermediate annealing; and a soaking treatment step for soaking a cold-rolled steel sheet obtained in the cold rolling step at 820° C. or less.

7. The method for producing a non-oriented electrical steel sheet according to claim 6, wherein the hot rolling step includes a roughing hot rolling step for obtaining a bar by setting the steel ingot or slab at a temperature from 1100° C. or more to 1300° C. or less and then applying a roughing hot rolling with a cumulative rolling reduction ratio of 80% or more, and a finishing hot rolling step for subjecting the bar to a finishing hot rolling, and wherein a temperature of the bar before the finishing hot rolling step is 950° C. or more.

8. The method for producing a non-oriented electrical steel sheet according to claim 7, wherein an average equiaxed crystal ratio in the cross-section of the steel ingot or slab is 25% or more.

9. The method for producing a non-oriented electrical steel sheet according to claim 6, wherein a cold-rolled steel sheet with a thickness from 0.15 mm or more to 0.80 mm or less and a tensile strength of 850 MPa or more is produced in the cold rolling step.

10. The method for producing a non-oriented electrical steel sheet according to claim 6, including a hot-rolled band annealing step for subjecting the hot-rolled band to a hot-rolled band annealing.

11. A rotor core formed by laminating the non-oriented electrical steel sheet according to claim 1.

12. A rotating machine using the rotor core according to claim 11.

* * * * *